US008408460B2

(12) United States Patent
Schneider et al.

(10) Patent No.: US 8,408,460 B2
(45) Date of Patent: Apr. 2, 2013

(54) AUTO ADJUSTING RANGING DEVICE

(75) Inventors: John Felix Schneider, Huntingburg, IN (US); Christopher Allen Brown, Bloomington, IN (US)

(73) Assignee: United States of America as represented by the Secretary of the Navy, Washington, DC (US)

( * ) Notice: Subject to any disclaimer, the term of this patent is extended or adjusted under 35 U.S.C. 154(b) by 43 days.

(21) Appl. No.: 12/793,503

(22) Filed: Jun. 3, 2010

(65) Prior Publication Data

US 2011/0297744 A1 Dec. 8, 2011

(51) Int. Cl.
*G06G 7/80* (2006.01)

(52) U.S. Cl. ..... 235/412; 235/404; 235/414; 235/417

(58) Field of Classification Search ..... 235/400, 235/404, 407, 412, 414, 417
See application file for complete search history.

(56) References Cited

U.S. PATENT DOCUMENTS

| | | | | |
|---|---|---|---|---|
| 3,672,782 | A * | 6/1972 | Akin, Jr. | 356/251 |
| 4,561,204 | A * | 12/1985 | Binion | 42/122 |
| 4,665,622 | A * | 5/1987 | Idan | 42/113 |
| 4,965,439 | A * | 10/1990 | Moore | 235/404 |
| 4,993,833 | A * | 2/1991 | Lorey et al. | 356/252 |
| 5,026,158 | A * | 6/1991 | Golubic | 356/252 |
| 5,623,335 | A | 4/1997 | Bamberger | |
| 5,686,690 | A * | 11/1997 | Lougheed et al. | 89/41.17 |
| 6,269,581 | B1 * | 8/2001 | Groh | 42/122 |
| 6,357,158 | B1 * | 3/2002 | Smith, III | 42/122 |
| 6,373,628 | B1 | 4/2002 | Gunnarsson et al. | |
| 6,813,025 | B2 * | 11/2004 | Edwards | 356/422 |
| 7,210,262 | B2 * | 5/2007 | Florence et al. | 42/132 |
| 7,225,578 | B2 * | 6/2007 | Tai | 42/132 |
| 7,234,265 | B1 | 6/2007 | Cheng et al. | |
| 7,292,262 | B2 * | 11/2007 | Towery et al. | 348/61 |
| 7,310,904 | B2 | 12/2007 | Ugolini et al. | |
| 7,421,816 | B2 * | 9/2008 | Conescu | 42/122 |
| 7,905,046 | B2 * | 3/2011 | Smith, III | 42/142 |
| 7,965,337 | B2 * | 6/2011 | Holmberg | 348/375 |
| 8,059,196 | B2 * | 11/2011 | Holmberg | 348/375 |
| 2002/0078618 | A1 * | 6/2002 | Gaber | 42/123 |
| 2004/0020099 | A1 * | 2/2004 | Osborn, II | 42/122 |
| 2004/0088898 | A1 * | 5/2004 | Barrett | 42/119 |
| 2004/0231220 | A1 * | 11/2004 | McCormick | 42/120 |
| 2005/0246910 | A1 * | 11/2005 | Mowers | 33/266 |
| 2005/0252062 | A1 * | 11/2005 | Scrogin et al. | 42/119 |
| 2005/0268521 | A1 * | 12/2005 | Cox et al. | 42/130 |
| 2006/0010760 | A1 * | 1/2006 | Perkins et al. | 42/142 |
| 2006/0010762 | A1 * | 1/2006 | Lin et al. | 42/142 |
| 2006/0201047 | A1 * | 9/2006 | Lowrey | 42/122 |
| 2007/0137090 | A1 * | 6/2007 | Conescu | 42/142 |
| 2007/0277421 | A1 * | 12/2007 | Perkins et al. | 42/122 |
| 2008/0060248 | A1 * | 3/2008 | Pine et al. | 42/114 |
| 2010/0083554 | A1 * | 4/2010 | Elpedes et al. | 42/123 |

FOREIGN PATENT DOCUMENTS

| | | |
|---|---|---|
| DE | 19940118 | 3/2001 |
| DE | 19949800 | 4/2001 |
| EP | 1804017 A1 | 7/2007 |
| GB | 1306674 | 2/1973 |
| WO | WO2006097310 | 9/2006 |

* cited by examiner

*Primary Examiner* — Daniel Hess
*Assistant Examiner* — Paultep Savusdiphol
(74) *Attorney, Agent, or Firm* — Christopher A. Monsey

(57) ABSTRACT

A ranging system for use with a projectile launching device is provided. The ranging system includes an alignment marker visible with an optical sight device. The position of the alignment marker is adjusted based at least on a determined range to a target.

37 Claims, 18 Drawing Sheets

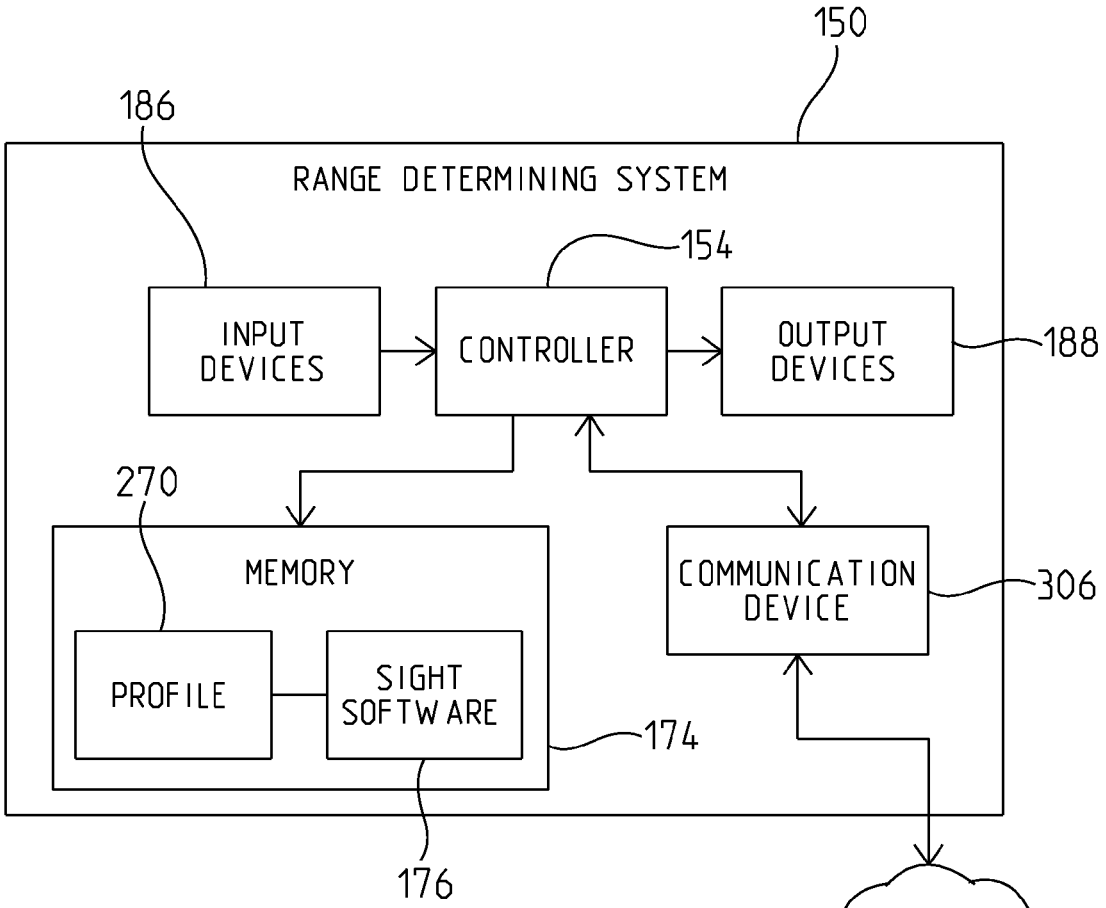
FIG. 12
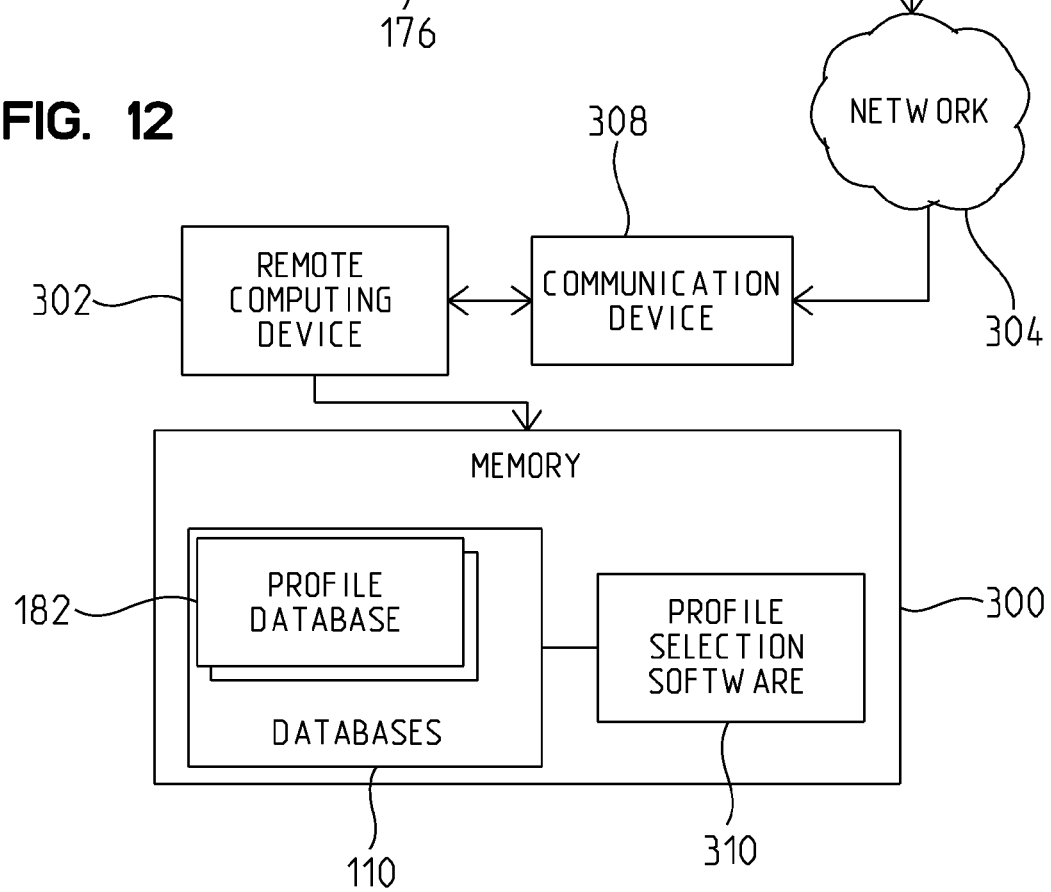

AUTO ADJUSTING RANGING DEVICE

STATEMENT REGARDING FEDERALLY SPONSORED RESEARCH OR DEVELOPMENT

The invention described herein was made in the performance of official duties by employees of the Department of the Navy and may be manufactured, used and licensed by or for the United States Government for any governmental purpose without payment of any royalties thereon.

BACKGROUND AND SUMMARY

The present invention relates generally to ranging systems for projectile launching devices and, more particularly, to ranging systems providing a moveable alignment marker which is positioned based on a range to a target object.

Projectile launching devices including sights operably coupled to rangefinders to determine a range to a target are known. Exemplary rangefinders include laser rangefinders which are devices that send out a pulsed optical signal from a source. The signal propagates through an environment and reflects off of a target object. The reflected energy, if of sufficient strength, is sensed by a sensing unit of the laser rangefinder. As is known, based on the time difference between the occurrence of sending out the optical signal and sensing the optical signal, a range to the target object may be determined.

In an exemplary embodiment of the present disclosure, a method of indicating the expected location of a projectile relative to a target object with an optical sight is provided. The method includes the steps of supporting an optical sight on a projectile launcher, the optical sight including a window, and coupling an identification device of the window to a controller. The method further includes the steps of identifying a parameter of the window from the identification device, determining a range to the target object, providing an alignment marker within the window of the optical sight, calibrating a position of the alignment marker based on a profile including the parameter of the window, and altering the position of the alignment marker within the field of view of the optical sight based at least on the range to the target object.

In another exemplary embodiment of the present disclosure, a ranging system for use with a projectile launching device to aim at a target object is provided. The ranging system includes a rangefinder supported by the projectile launching device and configured to determine a range to the target object, and an optical sight supported by the projectile launching device and including an identification device for providing a parameter of the optical sight. The optical sight further includes a field of view, the target object being viewable through the field of view. At least one optical source provides an alignment marker within the field of view of the optical sight, the alignment marker indicating a position that a projectile of the projectile launching device will hit at the location of the target object. A controller is operably coupled to the rangefinder and the at least one optical source. An interface is supported by the projectile launching device and is configured to couple the identification device of the optical sight with the controller. The controller determines a position of the alignment marker within the field of view of the optical sight based at least on the range to the target object and the parameter from the identification device.

In a further exemplary embodiment of the present disclosure, the ranging system includes an optical sight having a mount, a window supported by the mount, and a coupler removably coupling the window to the mount. The interface is supported by the mount and is operably coupled to the identification device of the window. The controller is operably coupled to the rangefinder, the interface, and the optical source, the controller determining a position of the alignment marker within the window of the optical sight based at least on the range to the target object and the parameter of the optical window.

BRIEF DESCRIPTION OF THE DRAWINGS

The foregoing aspects and many of the attendant advantages of this invention will become more readily appreciated as the same become better understood by reference to the following detailed description when taken in conjunction with the accompanying drawings.

FIG. 12 is a representative view of a profile stored on a memory of a controller of the optical sight system of FIG. 1 wherein the profile is provided from a profile database associated with a remote computing device;

Figure 1:
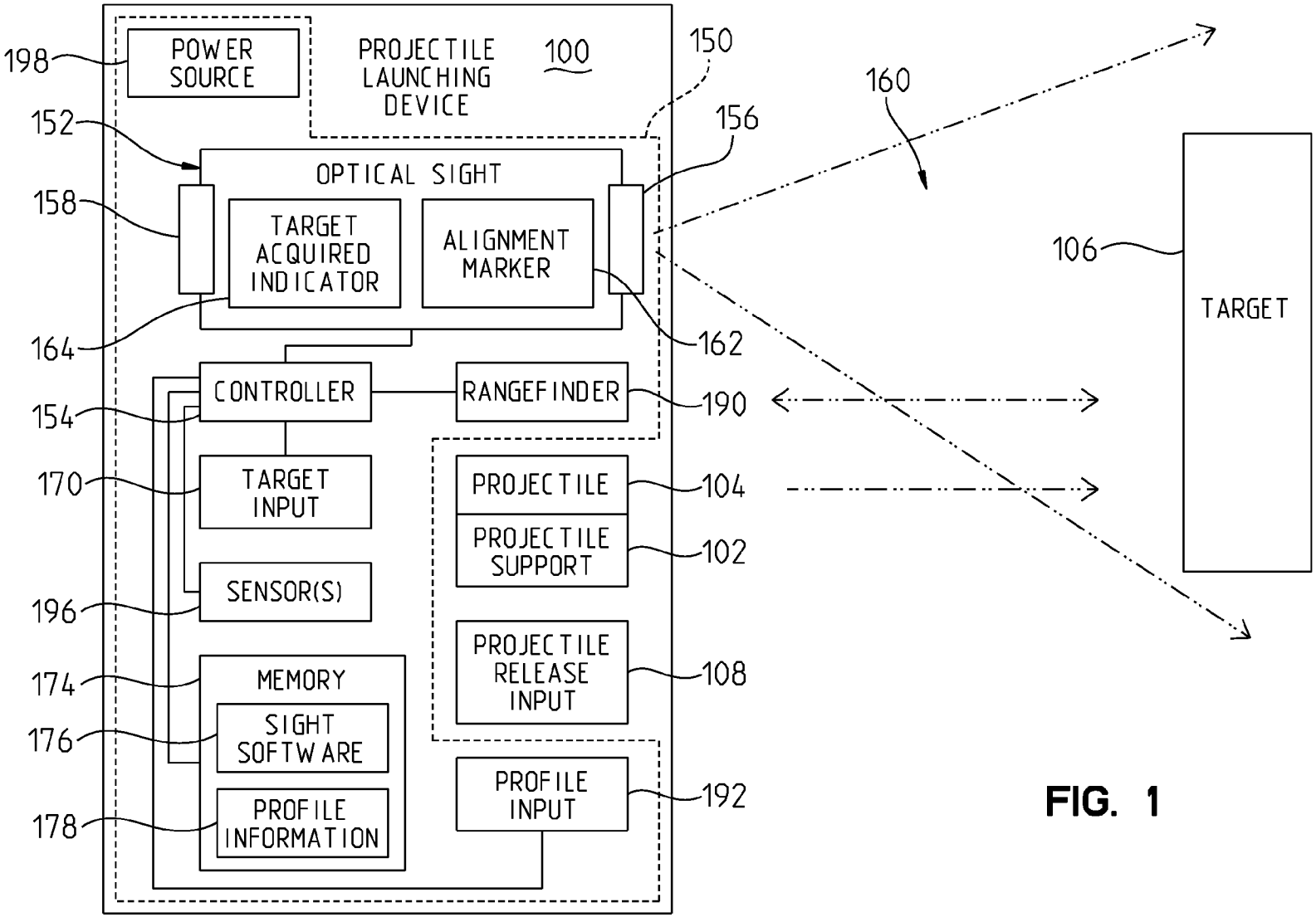
FIG. 1 is a representative view of a projectile launching device including an optical sight system.

Corresponding reference characters indicate corresponding parts throughout the several views. Although the drawings represent embodiments of various features and components according to the present disclosure, the drawings are not necessarily to scale and certain features may be exaggerated in order to better illustrate and explain the present disclosure. The exemplification set out herein illustrates embodiments of the invention, and such exemplifications are not to be construed as limiting the scope of the invention in any manner.

DETAILED DESCRIPTION OF THE DRAWINGS

For the purposes of promoting an understanding of the principles of the invention, reference will now be made to the embodiments illustrated in the drawings, which are described below. The embodiments disclosed below are not intended to be exhaustive or limit the invention to the precise form disclosed in the following detailed description. Rather, the embodiments are chosen and described so that others skilled in the art may utilize their teachings. It will be understood that no limitation of the scope of the invention is thereby intended. The invention includes any alterations and further modifications in the illustrated devices and described methods and further applications of the principles of the invention which would normally occur to one skilled in the art to which the invention relates.

Referring to FIG. 1, a projectile launching device 100 is represented. Projectile launching device 100 includes a projectile support 102 and one or more projectiles 104. Exemplary projectile launching device 100 include firearms, such as firearm 110 shown in FIG. 2, bows, such as bow 120 shown in FIG. 3, and other devices which are capable of launching one or more projectiles 104 towards a target 106. In one embodiment, the projectile 104 is launched in response to a state of a projectile release input 108.

Figures 2, 2A:
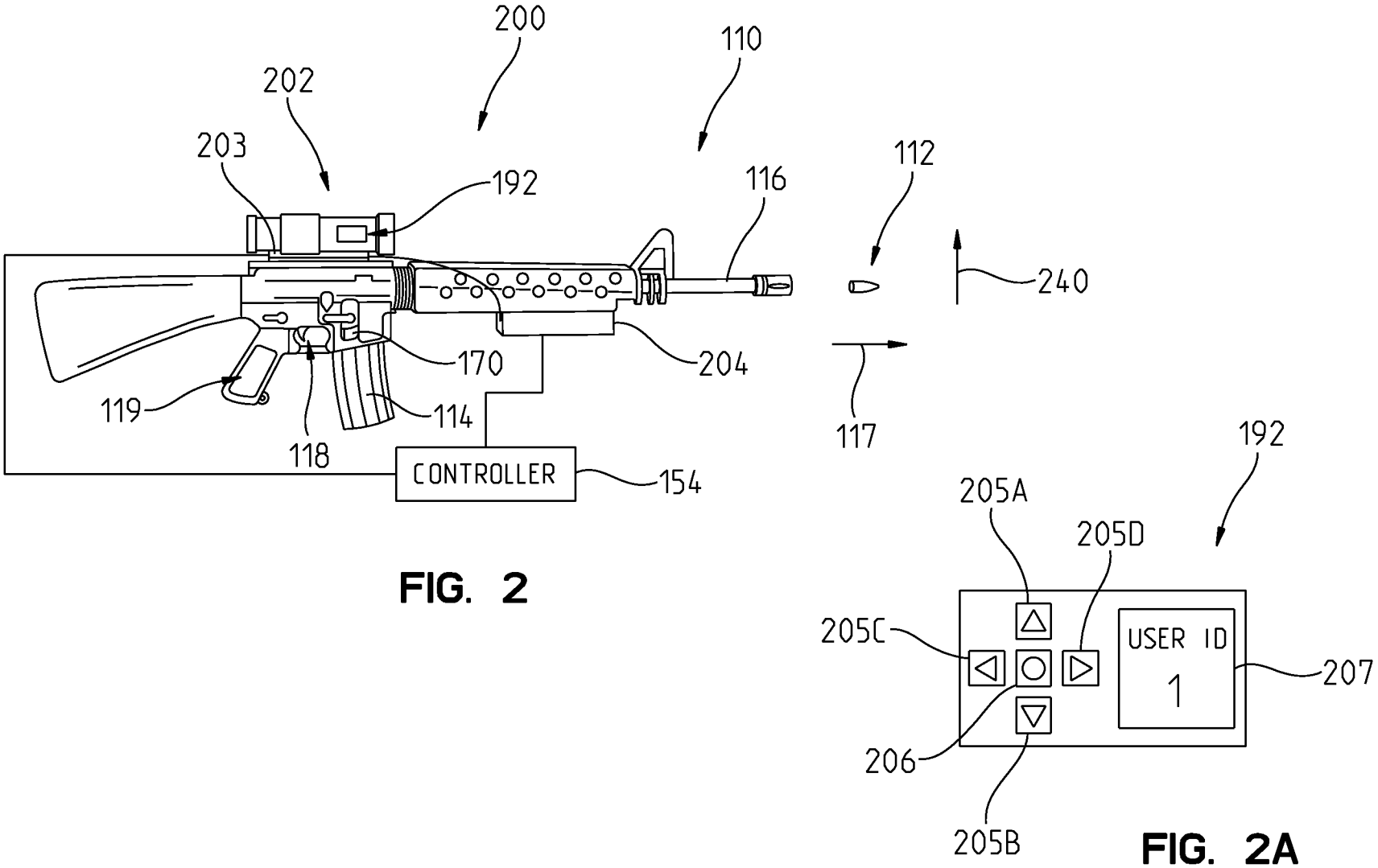
FIG. 2 is a representative view of a firearm which is an exemplary type of projectile launching device including the optical sight system of FIG. 1.
FIG. 2A is a detail view of the user input device of the optical sight system of FIG. 2.

Turning to FIG. 2, in the case of firearm 110, multiple projectiles 104, illustratively bullets 112, are housed in a magazine 114 and supported sequentially for alignment with a barrel 116 by firearm 110. The bullets 112 are launched from firearm 110 in direction 117 in response to projectile release input 108, illustratively trigger 118, being pulled. In various illustrative embodiments, firearm 110 may be an automatic firearm, a semi-automatic firearm, or a single action firearm.

Figure 3:
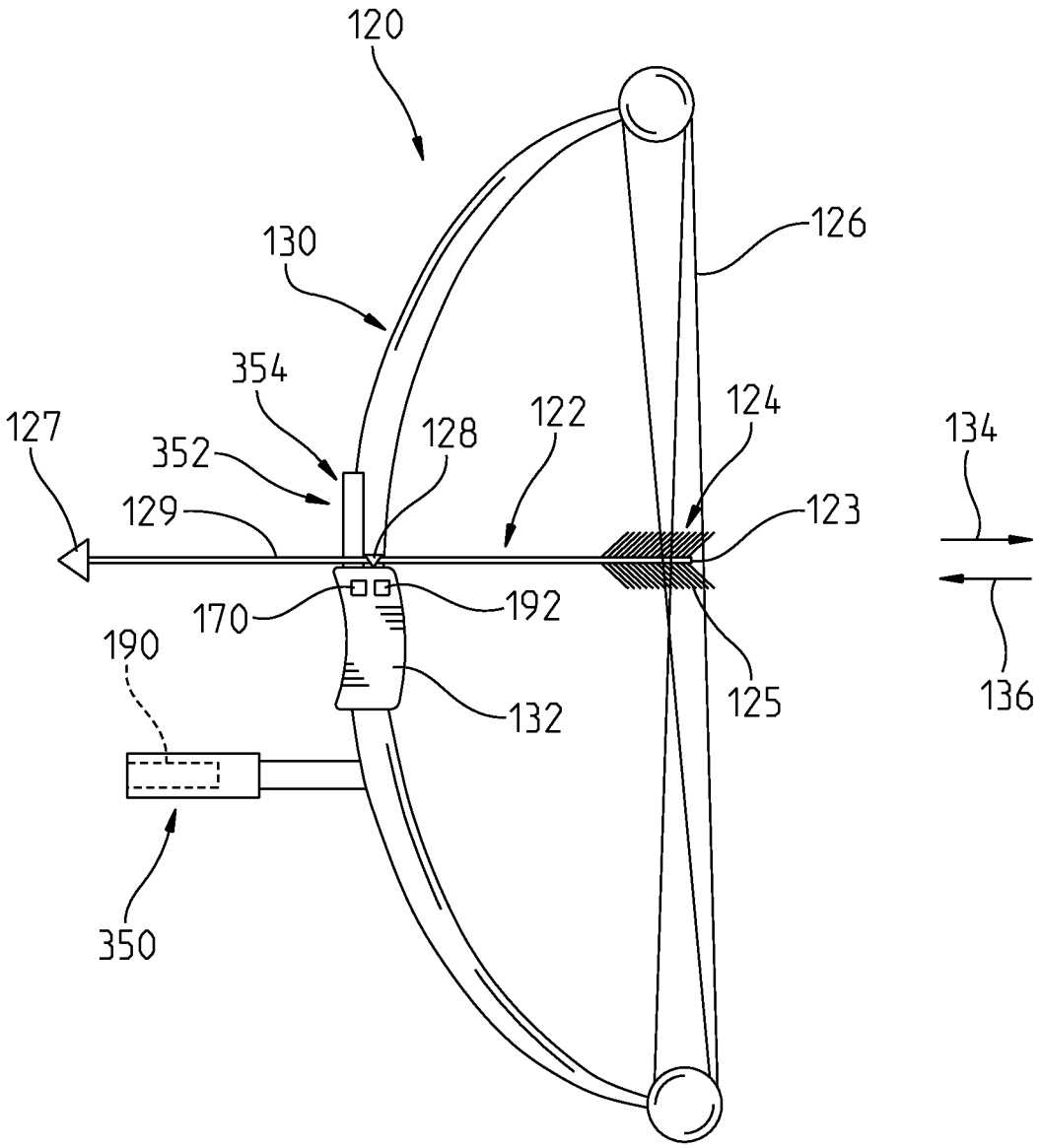
FIG. 3 is a representative view of a bow which is an exemplary type of projectile launching device including an optical sight system.

Turning to FIG. 3, in the case of bow 120, a single projectile 104, illustratively arrow 122, is supported by bow 120. A rear portion 124 of arrow 122 illustratively includes a notch 123 to receive projectile release input 108, illustratively a portion of bowstring 126. The rear portion 124 of arrow 122 also includes fletching or fins 125 that are configured to impart stability during flight. A front portion of arrow 122 includes a blade or arrowhead 127. An intermediate portion of shaft 129 of arrow 122 is supported by an arrow rest 128 supported by a base portion 130 of bow 120. A user of bow 120 holds onto a hand grip 132. The arrow 122 is shot by pulling the arrow 122 and bowstring 126 back in direction 134 and subsequently allowing the arrow 122 and bowstring 126 to advance in direction 136 by releasing bowstring 126. In certain illustrative embodiments, bow 120 is a compound bow. In one illustrative embodiment, bow 120 is a long bow. In one illustrative embodiment, bow 120 is a recurve bow. In one illustrative embodiment, bow 120 may be a crossbow.

Returning to FIG. 1, a range determining or ranging system 150 is represented. The ranging system 150 includes an optical sight device 152 and a controller 154. The illustrative optical sight device 152 shown in FIG. 4 has a compound configuration, including a front window 156 and a rear window 158 oriented along a common longitudinal axis 159. Optical sight device 152, as with traditional optical sights, permits an operator to look through rear window 158 and front window 156 to see target 106 which is within a field of view 160 of optical sight device 152. In one embodiment, optical sight device 152 may be telescopic in that it includes an optical system which magnifies target 106 as seen through optical sight device 152. Exemplary optical systems include lenses, mirrors, or a combination of both. An exemplary optical system provides a magnification of target 106 so that target 106 appears closer to projectile launching device 100.

Figure 4:
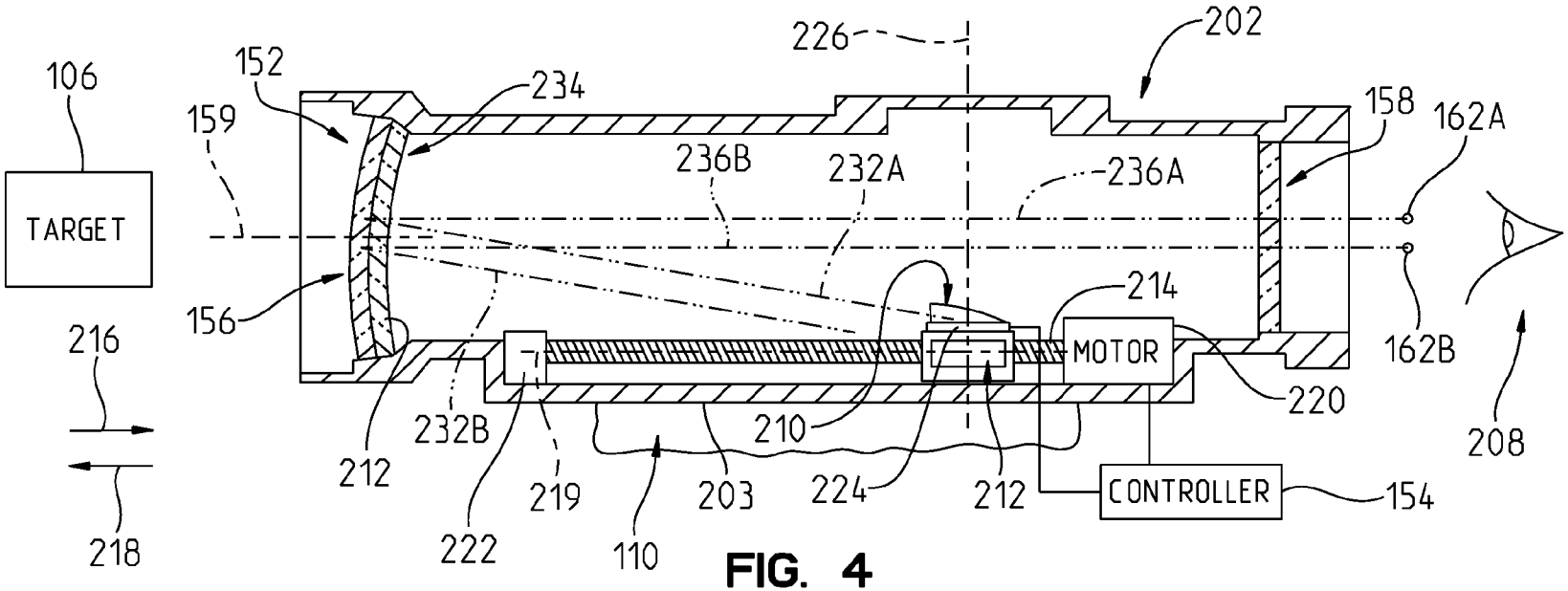
FIG. 4 is a representative longitudinal cross-sectional view of an optical sight device on the firearm of FIG. 2.
Figure 5:
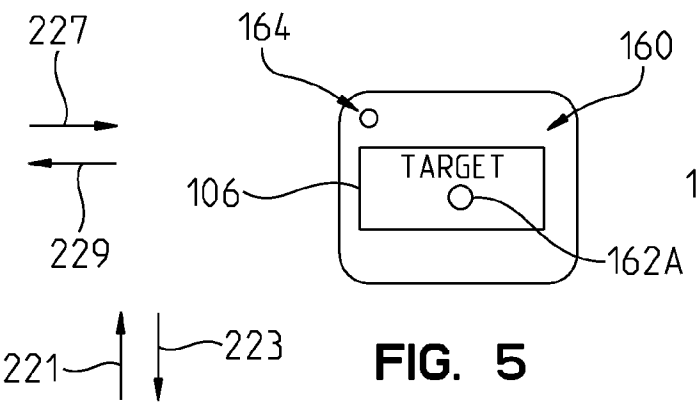
FIG. 5 is a representative view of an optical viewport of the optical sight system of FIG. 1 having an alignment marker at a first location.

With reference to FIGS. 1, 4, and 5, optical sight device 152 also includes an alignment marker 162. Alignment marker 162 overlays target 106 when viewed through rear window 158, defining a viewport of optical sight device 152. Alignment marker 162 provides an indication of the location that projectiles 104 will intersect with target 106. In one embodiment, alignment marker 162 is the only alignment marker visible when target 106 is viewed through optical sight device 152. In one embodiment, a position of alignment marker 162 is automatically adjusted by controller 154. Exemplary alignment markers include dots, crosshairs, lines, squares, and any other suitable shape.

Optical sight device 152 further includes a target acquired indicator 164. Target acquired indicator 164 provides an indication that ranging system 150 has located a target 106 and has determined a range to target 106. The state of target acquired indicator 164 is controlled by controller 154. In one embodiment, target acquired indicator 164 is a light visible when viewing target 106 through ranging system 150. Illustratively, target acquired indicator 164 is not aligned with target 106.

In one embodiment, controller 154 illuminates the light of target indicator 164 when ranging system 150 has determined a range to target 106 (FIGS. 6A and 6B) and does not illuminate the light of target indicator 164 when a target 106 has not been identified (FIG. 5). In one embodiment, alignment marker 162 also serves as target indicator 164. When a range to a target has not yet been determined the alignment marker 162 is a first color and when a range to the target has been determined alignment marker 162 is a second color, different from the first color. Alternatively, other characteristics (e.g., shape and/or illumination intensity) of the alignment marker 162 may change to provide an indication of range to target determination.

In the illustrative embodiment of FIG. 1, ranging system 150 includes a target input 170. Controller 154 maintains target acquired indicator 164 in a non-illuminated state until an operator activates target input 170. Then controller 154 attempts to determine a range to target 106. Once the range to target 106 has been determined, controller 154 illuminates the light of target acquired indicator 164. In one embodiment, target input 170 is a button provided on an exterior of one of ranging system 150 and projectile launching device 100.

The functionality of controller 154 may be provided in software, hardware, or a combination of both. In one embodiment, controller 154 is a computing device. Exemplary computing devices include processors. Although controller 154 is illustrated as a single device, it should be understood that multiple devices may be used together, such as over a network or other methods of transferring data.

Controller 154 has access to a memory 174. Controller 154 executes sight software 176 stored on the memory 174. Memory 174 is a computer readable medium and may be a single storage device or may include multiple storage devices, located either locally with controller 154 or accessible across a network. Computer-readable media may be any available media that may be accessed by controller 154 and includes both volatile and non-volatile media. Further, computer readable-media may be one or both of removable and non-removable media. By way of example, computer-readable media may include, but is not limited to, RAM, ROM, EEPROM, flash memory or other memory technology, CD-ROM, Digital Versatile Disk (DVD) or other optical disk storage, magnetic cassettes, magnetic tape, magnetic disk storage or other magnetic storage devices, or any other medium which may be used to store the desired information and which may be accessed by controller 154.

Memory 174 illustratively includes sight software 176. Although described as software, it is understood that at least portions of sight software 176 may be implemented as hardware. As explained herein, sight software 176, based on a plurality of inputs, determines a position of alignment marker 162 within viewport of optical sight device 152. Also, as explained herein, sight software 176 may reference profile information 178 associated with projectile launching device 100, ranging system 150, and optical sight device 152. In one embodiment, reference profile information 178 is stored in a file or as a plurality of variable values. In one embodiment, reference profile information 178 is stored on memory 174 within a database.

Figure 11:
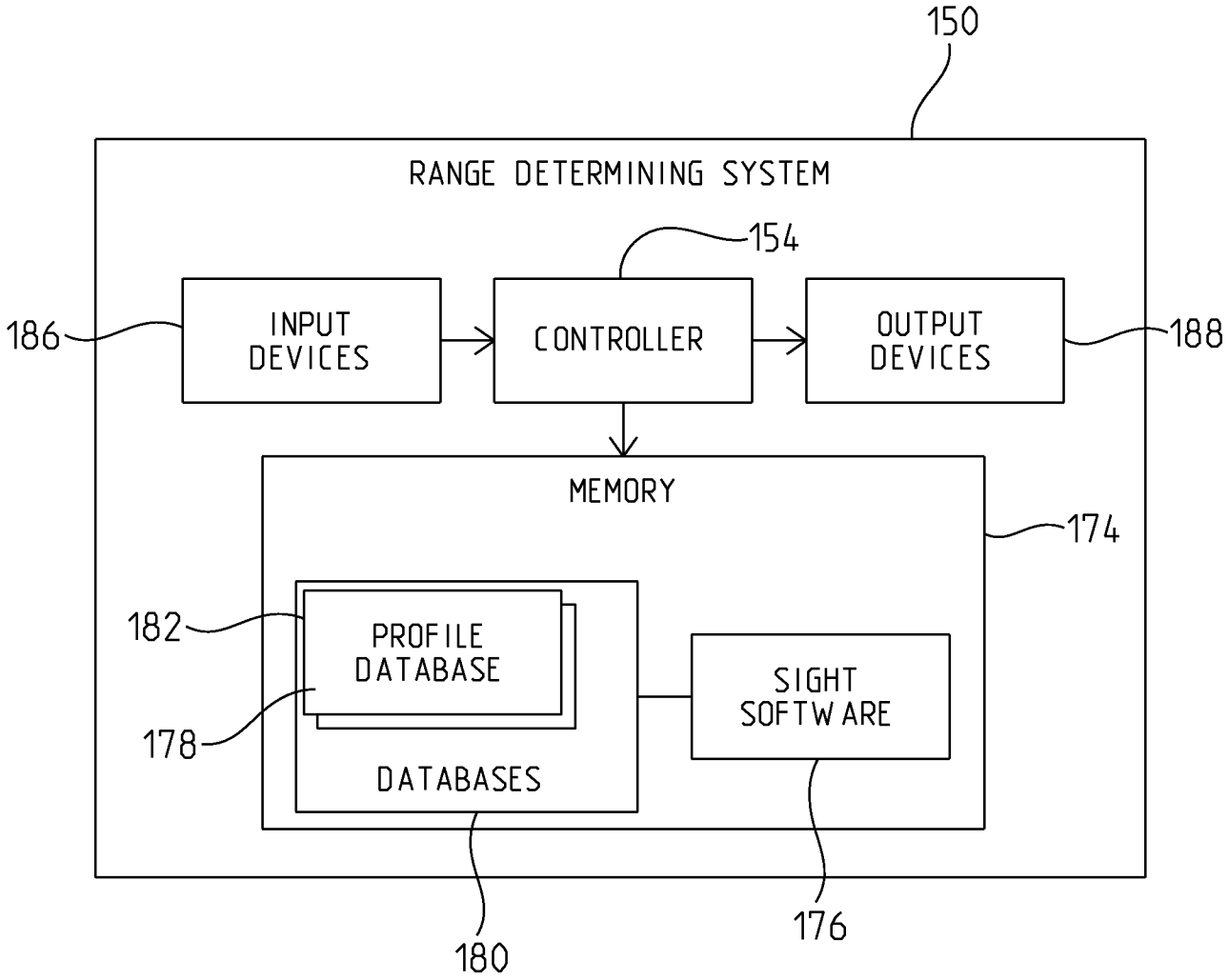
FIG. 11 is a representative view of the profile database of FIG. 9 stored on a memory of a controller of the optical sight system of FIG. 1.

Referring to FIG. 11, controller 154 is shown as having access to one or more databases 180 stored in memory 174. The databases 180 includes at least one profile database 182 which includes reference profile information 178. As explained herein, based on input from input devices 186, such as target input 170 and a rangefinder 190, controller 154 with sight software 176 is able to determine a position of an output device 188, such as alignment marker 162. In one embodiment, this determination is based on reference profile information 178 and the other inputs. In one embodiment, reference profile information 178 is selected from profile database 182 based on an input from a profile input device or user interface 192.

In one embodiment, an operator provides an operator number (e.g., user ID) or other identifying information through profile, or user, input device 192 to inform controller 154 of the current operator of ranging system 150. As different people have different sighting characteristics, ranging system 150 is able to adapt to different people based on the operator identifier supplied through profile input device 192. In one embodiment, an operator provides a projectile launching device number (e.g., weapon ID) or other identifying information of the projectile launching device through profile input 192 to inform controller 154 of the current projectile launching device associated with ranging system 150. As different projectile launching devices have different characteristics, ranging system 150 is able to adapt to different projectile launching devices based on the projectile launching device identifier supplied through profile input device 192. In a similar fashion, an operator may specify a projectile number (e.g., ballistic ID) or other identifying information through profile input device 192 to inform controller 154 of the current projectile being used with projectile launching device 100. As different projectiles have different characteristics, ranging system 150 is able to adapt to different projectiles based on the projectile identifier supplied through profile input device 192. As further detailed herein, parameters of the window 156 of optical sight device 152 (e.g., lens ID) may be provided through input device 192, or through a direct interface with the controller 154.

Further, in one embodiment, one or more sensors 196 provide input to controller 154 regarding the potential flight path of projectiles 104. Exemplary sensors include environmental sensors. Illustrative environmental sensors include wind sensors, humidity sensors, temperature sensors, and other suitable environmental sensors.

Ranging system 150 further includes a power source 198 which provides electrical power to the components of ranging system 150. An exemplary power source 198 is a portable energy storage device, such as one or more batteries.

Referring further to FIGS. 2 and 4, an exemplary ranging system 200 is shown for use with firearm 110. System 200 in one illustrative example of ranging system 150. System 200 includes a first housing 202 having a mount 203 coupled to a top portion of firearm 110, and a second housing 204 coupled to a bottom portion of firearm 110. First housing 202 includes at least optical sight device 152. Second housing 204 includes at least rangefinder 190. In other illustrative embodiments, the first housing 202 and the second housing 204 may be combined into a single housing supported above the firearm 110.

Profile input device 192 is illustrated as being supported by first housing 202 and including a plurality of buttons 205, 206 which are actuatable from an exterior of first housing 202. Profile input device 192 may instead be located on second housing 204 or firearm 110. Profile input device 192 may be any suitable type of input device 186. Exemplary input devices include buttons, dials, touch sensors, switches, and other suitable input devices.

FIG. 2A shows an illustrative profile input device or user interface 192 including up and down buttons 205A and 205B and left and right buttons 205C and 205D. A center selection button 206 may be positioned intermediate the buttons 205A, 205B, 205C, 205D. A display, such as a liquid crystal display (LCD) 207, may be provided to provide output to an operator 208. The input device 192 may be menu driven such that buttons 205 permit the operator 208 to scroll through different options and select a desired option by depressing selection button 206.

Target input device 170 is illustrated as a button which is actuatable from an exterior of firearm 110. Target input 170 is shown placed proximate to trigger 118 so that an operator may actuate target input 170 with his finger while still holding on to a grip 119 with the remainder of his hand. Target input 170 may be located on other areas of firearm 110, such as grip 119 and trigger 118. Further, target input 170 may instead be located on first housing 202 (including being incorporated within user interface 192) or second housing 204. Target input 170 may be any suitable type of input device 186. Exemplary input devices include buttons, dials, touch sensors, switches, and other suitable input devices.

Referring to FIG. 4, a sectional view of first housing 202 is shown. As stated above, first housing 202 includes ranging system 150. An operator 208 looks through rear window 158 and front window 156 to view target 106. Ranging system 150 includes an optical system 234 through which operator 208 sees target 106. An exemplary optical system is disclosed in U.S. Pat. No. 6,373,628, the disclosure of which is expressly incorporated by reference herein.

First housing 202 further illustratively includes an optical or light source 210 to project alignment marker 162 on front window 156. Exemplary light sources 210 include directional light sources, such as laser diodes. A position of light source 210 is adjusted to alter a position of alignment marker 162 on front window 156 and as such, within field of field of view 160 (see FIGS. 4-6B) of ranging system 150. In an alternate embodiment, a direction that the light exits a fixed light source 210 is adjusted to alter a position of alignment marker 162 within field of view 160. In one embodiment, a plurality of light sources 210 are provided and the position of alignment marker 162 is adjusted based on which one of light sources 210 is active, only a single source being active at a time. In one embodiment, ranging system 150 is a red dot sight, wherein the light source 210 projects red light onto the front window 156.

Illustratively, optical sight device 152 may comprise a reflex sight in that the alignment marker 162 is projected forward from light source 210 from a point behind the front window 156, and is then reflected off the back of the front window 156 toward the eye of the operator 208. The front window 156 is therefore a partial mirror in that a reflective lens coating or liner 212 is configured to reflect only the wavelength (color) of the light emitted by the light source 210. Other visible wavelengths will pass normally through the front window 156.

In the illustrated embodiment, light source 210 is provided on a movable base, illustratively a sled 212, having at least two degrees of freedom. More particularly, sled 212 is capable of translational movement in direction 216 and direction 218, parallel to longitudinal axis 219 of mount 203, and therefore parallel to longitudinal optical axis 159. In the illustrated embodiment, sled 212 is threadably coupled to a threaded rod 214 which is coupled to a motor 220 at a first end and a support block 222 at a second end. Motor 220 rotates threaded rod 214 in a first direction to advance sled 212 in direction 216, and rotates threaded rod 214 in a second direction to retract sled 212 in direction 218. A motor 224 may be supported by sled 212 and is configured to pivot light source 210 about a rotational axis 226 extending perpendicular to axis 219. Motors 220 and 224 are operably coupled to controller 154.

Controller 154 provides an input to motor 220 regarding the correct position of sled 212 and light source 210 along longitudinal axis 219 (i.e., translational movement). The correct position of sled 212 along axis 219 corresponds to a desired vertical position of alignment marker 162 (as represented by direction arrows 221 and 223 in FIG. 5) in field of view 160 for the given orientation of optical sight device 152 in FIGS. 2, 4 and 5. Referring to FIG. 5, alignment marker 162A is shown aligned to target 106. Based at least on a range to target 106, controller 154 determines the likely position of bullets 112 at the plane of target 106 and moves sled 212 to alter alignment marker 162 to alignment marker 162B shown in FIG. 6A. The operator 208 now knows that at the current orientation of firearm 110 that bullets 112 will hit below target 106. As such, the operator 208 raises a front portion or barrel 116 of firearm 110 in direction 240 (see FIG. 2) to align alignment marker 162B with target 106.

Controller 154 also provides an input to motor 224 regarding the correct position of light source 210 about axis 226 (i.e., rotational movement). The correct position of light source 210 about axis 226 corresponds to a desired horizontal position of alignment marker 162 (as represented by direction arrows 227 and 229 in FIG. 5) within field of view 160 for the given orientation of optical sight device 152 in FIGS. 2, 4 and 5. Based on inputs from sensors 196, for example, the alignment marker 162 may be altered to the left or right of alignment marker 162A shown in FIG. 5. For example, windage as sensed from a wind sensor may be utilized by the controller 154 to activate motor 224 and rotate light source 210 about axis 226. The operator 208 now knows that at the current orientation of the firearm 110 that bullets will hit either left or right of target 106. As such, the operator 208 moves the front portion or barrel 116 of firearm 110 to the left or right, as appropriate, to align alignment marker 162 with target 106.

Figure 6B:
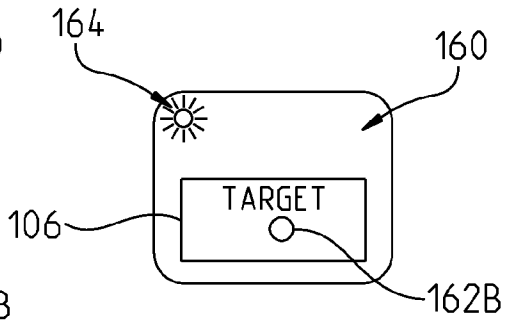
FIGS. 6A and 6B are representative views of an optical viewport of the optical sight system of FIG. 1 having an alignment marker at a second location.

As is shown in FIGS. 5-6B, alignment marker 162 is the only alignment marker shown in field of view 160. In this manner, operator 208 is not distracted by the presence of other alignment marker 162, such as a fixed reticule.

Figure 7:
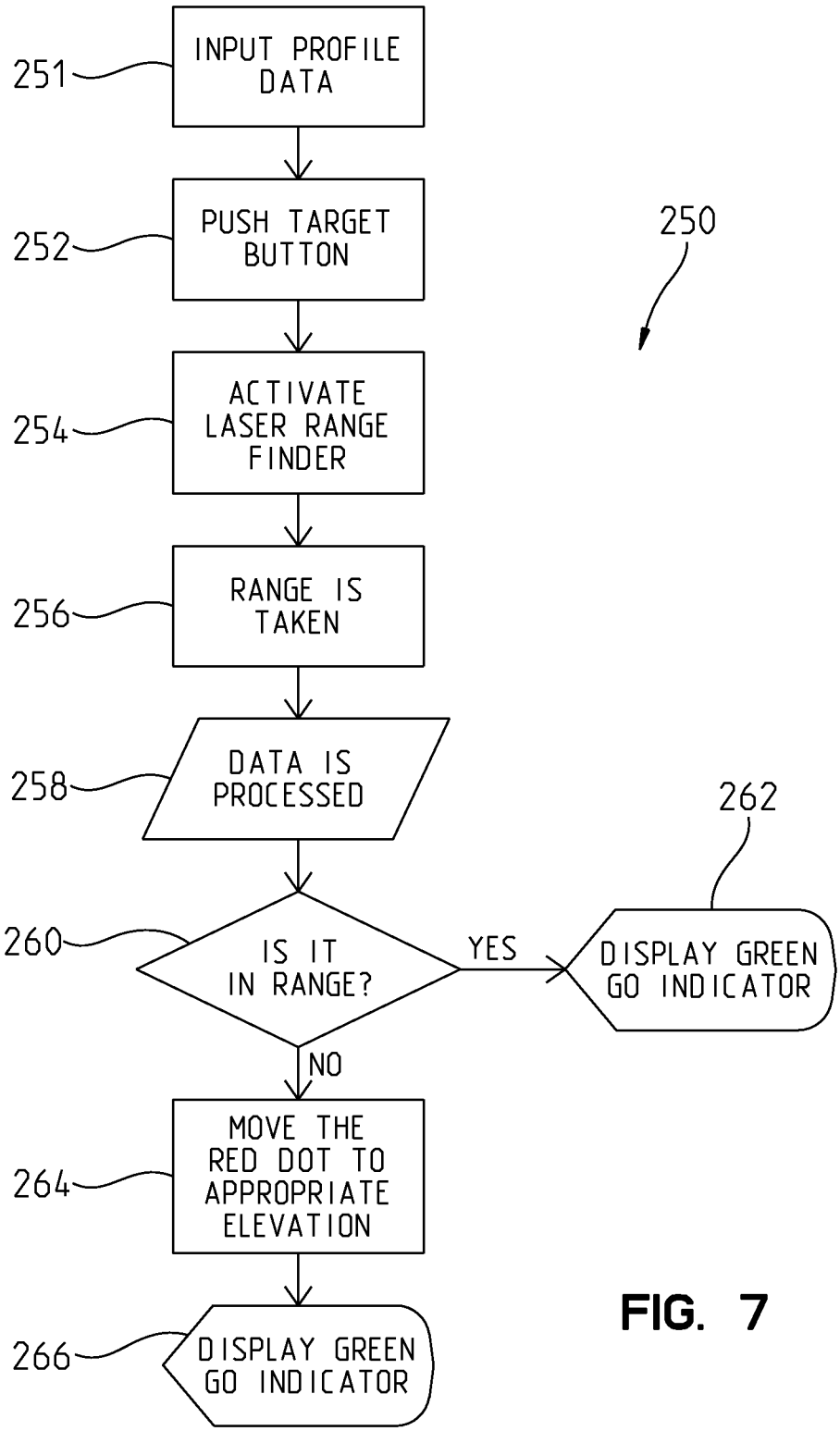
FIG. 7 is a representative view of a processing sequence of the optical sight system of FIG. 1.

Referring to FIG. 7, an exemplary processing sequence 250 of ranging system 150 is shown. An operator 208 of firearm 110 illustratively inputs reference profile information 178 through input device 192, at block 251. Next, the operator 208 aligns alignment marker 162 with target 106. The operator then presses target input 170, as represented by block 252. Controller 154 receives an indication of or detects that target input 170 has been pressed and activates rangefinder 190, as represented by block 254. The range to target 106 is determined, as represented by block 256. In one embodiment, rangefinder 190 is a standalone laser rangefinder unit which calculates the range to target 106 and reports that value to controller 154. In one embodiment, rangefinder 190 provides data to controller 154 which processes the data to determine the range to target 106.

Figure 9:
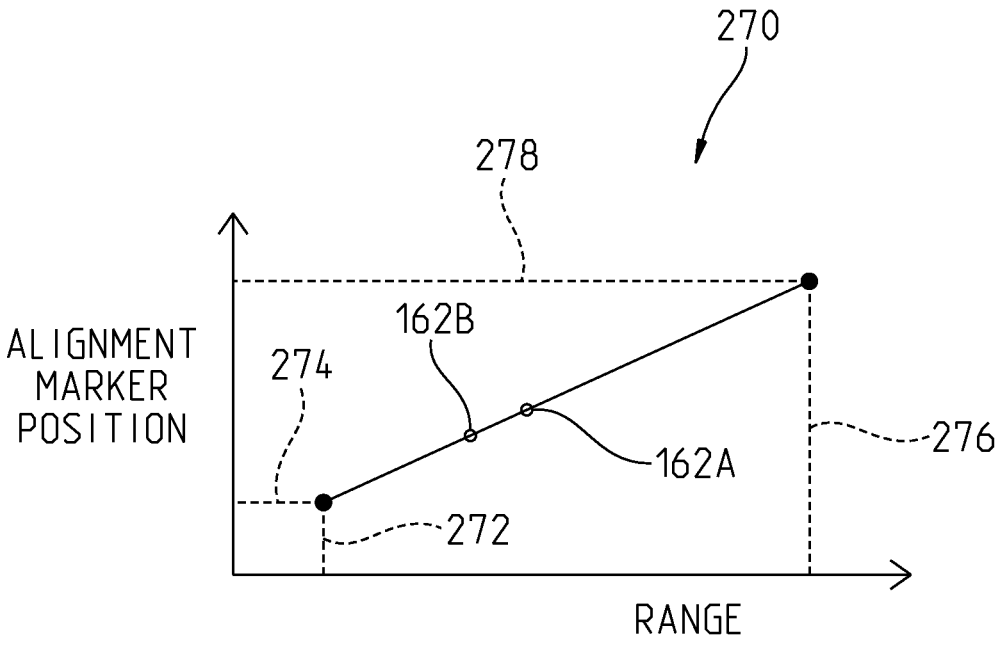
FIG. 9 is a representative view of an exemplary range profile for the optical sight system of FIG. 1

Controller 154 determines if the current location of alignment marker 162 corresponds to the determined range to target 106, as represented by block 258. In one embodiment, controller 154 determines the correct location of alignment marker 162 based at least in part on reference profile information 178. Referring to FIG. 9, an exemplary profile 270 of reference profile information 178 is shown. Profile 270 provides a relationship between the range to target 106 and the height of alignment marker 162. In one embodiment, operator 208 calibrates reference profile information 178 by specifying at a first range 272 that the height of alignment marker 162 should be height 274 and at a second range 276 that the height of alignment marker 162 should be height 278.

Calibration of reference profile information 178 may be accomplished by utilizing user input device 192 at block 251 as noted above. More particularly, a calibration mode may be selected from a main menu shown in display 207. Arrow buttons 205A and 205B may be utilized to specify first range 272 and second range 276. Controller 154 then based on a linear relationship can determine an appropriate height for alignment marker 162 at various ranges. In one embodiment, more than two calibration points are used to determine exemplary profile 270. In one embodiment, exemplary profile 270 is not a linear relationship, but rather a high order relationship.

Returning to FIG. 7, if the current location of alignment marker 162 is correct, controller 154 displays a green indicator, target acquired indicator 164, in field of view 160, as represented by block 262. If the current location of alignment marker 162 is not correct, controller 154 instructs motor 220 to move light source 210 to a location that corresponds to alignment marker 162 being in the correct location, as represented by block 264. Once alignment marker 162 is in the correct location, target acquired indicator 164 is illuminated.

Figure 6A:
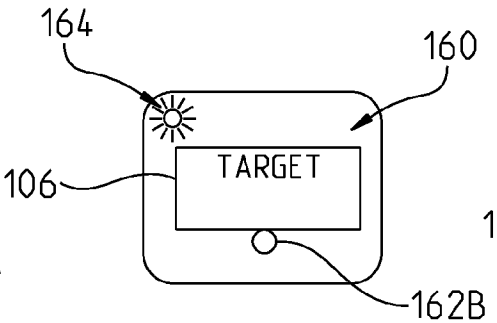

This process is illustrated with reference to FIGS. 5, 6A, and 6B. Referring to FIG. 5, alignment marker 162A is shown aligned to target 106. Once block 252 is pressed, controller 154 determines based on the range to target 106 whether target 106 is in range based on current position of alignment marker 162. Since it is not, target acquired indicator 164 is not illuminated. Rather, controller 154 moves sled 212 to alter alignment marker 162 to alignment marker 162B shown in FIG. 6A. Based on that position of alignment marker 162, target 106 is in range and target acquired indicator 164 is illuminated. The operator now knows that at the current orientation of firearm 110 bullets 112 will hit below target 106. As such, the operator raises a front portion or barrel 116 of firearm 110 in direction 240 (see FIG. 2) to align alignment marker 162B with target 106 as shown in FIG. 6B. Alignment marker 162 is shown as moving up and down as sled 212 is moved along longitudinal axis 219 by operation of motor 220. In a further illustrative embodiment, alignment marker 162 also moves to the left or right as optical source 210 is rotated about longitudinal axis 226 by operation of motor 224. For example, this may be utilized to accommodate a cross wind (i.e. windage) which may be sensed by a wind sensor.

In one embodiment, target acquired indicator 164 and alignment marker 162 are combined. In one example, alignment marker 162 is a first color when target 106 is not in range and a second color when target 106 is in range. In one example, alignment marker 162 flashes when target 106 is not in range and is continuous when target 106 is in range.

Figure 10:
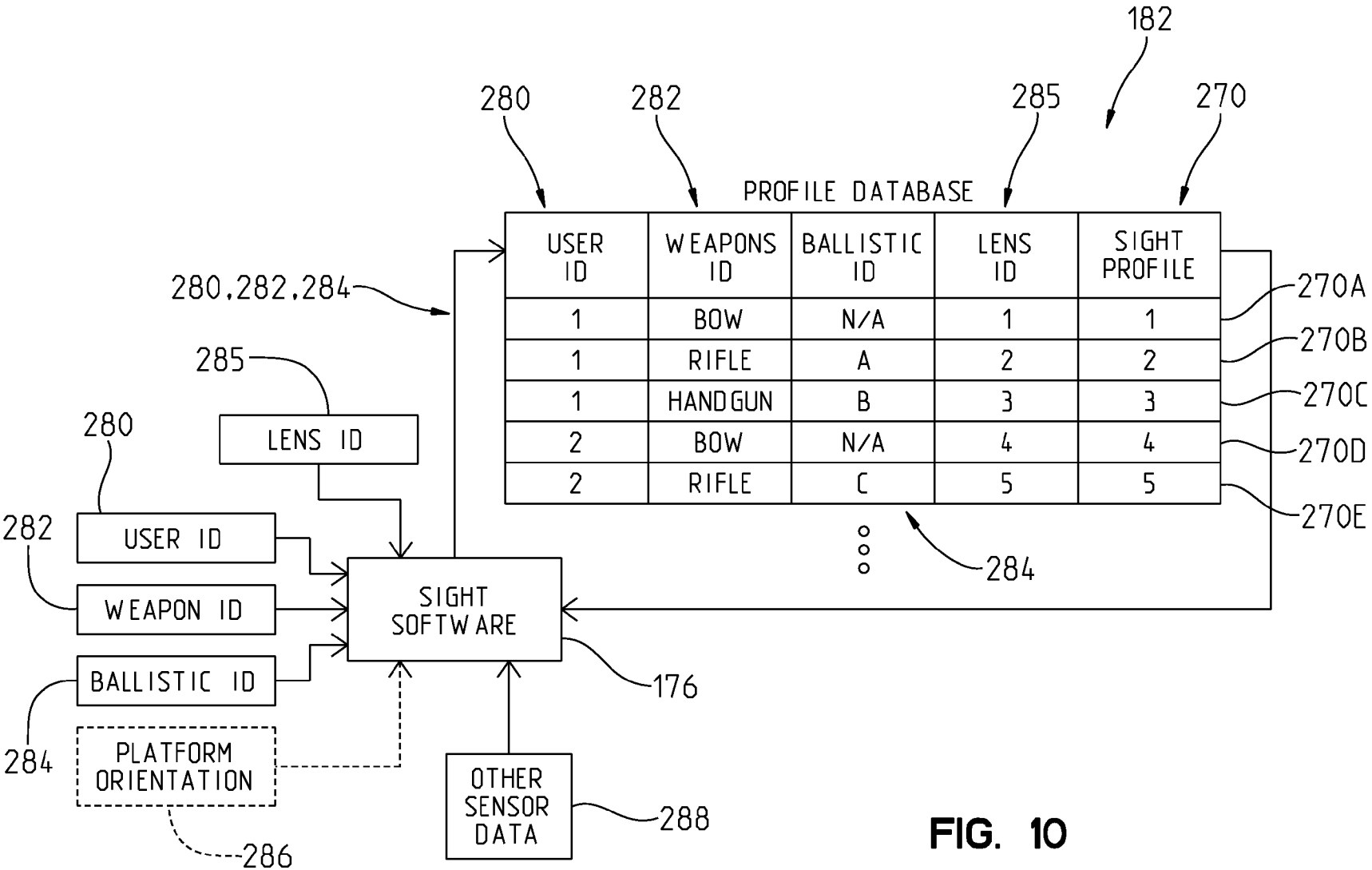
FIG. 10 is a representative view of a profile database for the optical sight system of FIG. 1.

Referring to FIG. 10, in one embodiment, exemplary profile 270 is selected from a profile database 182. Sight software 176 receives operator identification (i.e., user ID) 280, projectile launching identification (i.e., weapons ID) 282, ballistic identification (i.e., ballistic ID) 284, and lens identification (i.e., lens ID) 285. These values may be input through profile input device 192 or otherwise provided to sight software 176. For example, the profile database 182 may be supplied through various storage devices, either local or remote. Based on these values, a given exemplary profile 270 is selected from a plurality of profiles 270 stored in profile database 182. By including weapon identification 282, ranging system 150 may be used with multiple weapons reducing the number of sights an operator needs to own. Further, by including operator identification 280 multiple users may use the same weapon with the sight adjusted for their eyesight without losing the calibrations performed by other users. Ballistic identification 284 may include performance characteristics of the projectile 104, such as speed, travel distance, rate of drop, etc. Lens identification 285 may include details of the window 156, such as orientation relative to the projectile launching device 100 (e.g., vertical or horizontal), distance from the light source 210, type of lens (e.g., reflex or red dot, telescopic, fixed reticule, etc.), reflectivity characteristics, etc. In certain illustrative embodiments, less than all of operator identification 280, weapon identification 282, ballistic identification 284, and lens identification 285 are used to select the appropriate exemplary profile 270.

In one illustrative embodiment, an orientation 286 of firearm 110, such as the current angle relative to horizontal, and other sensor data 288 may be used to select the correct exemplary profile 270. In one illustrative embodiment, a mercury switch is provided to determine if firearm 110 is rotated left or right around its barrel. Further, a sensor may be provided to determine the angle of firearm 110 relative to horizontal along the barrel of firearm 110.

Figure 8A:
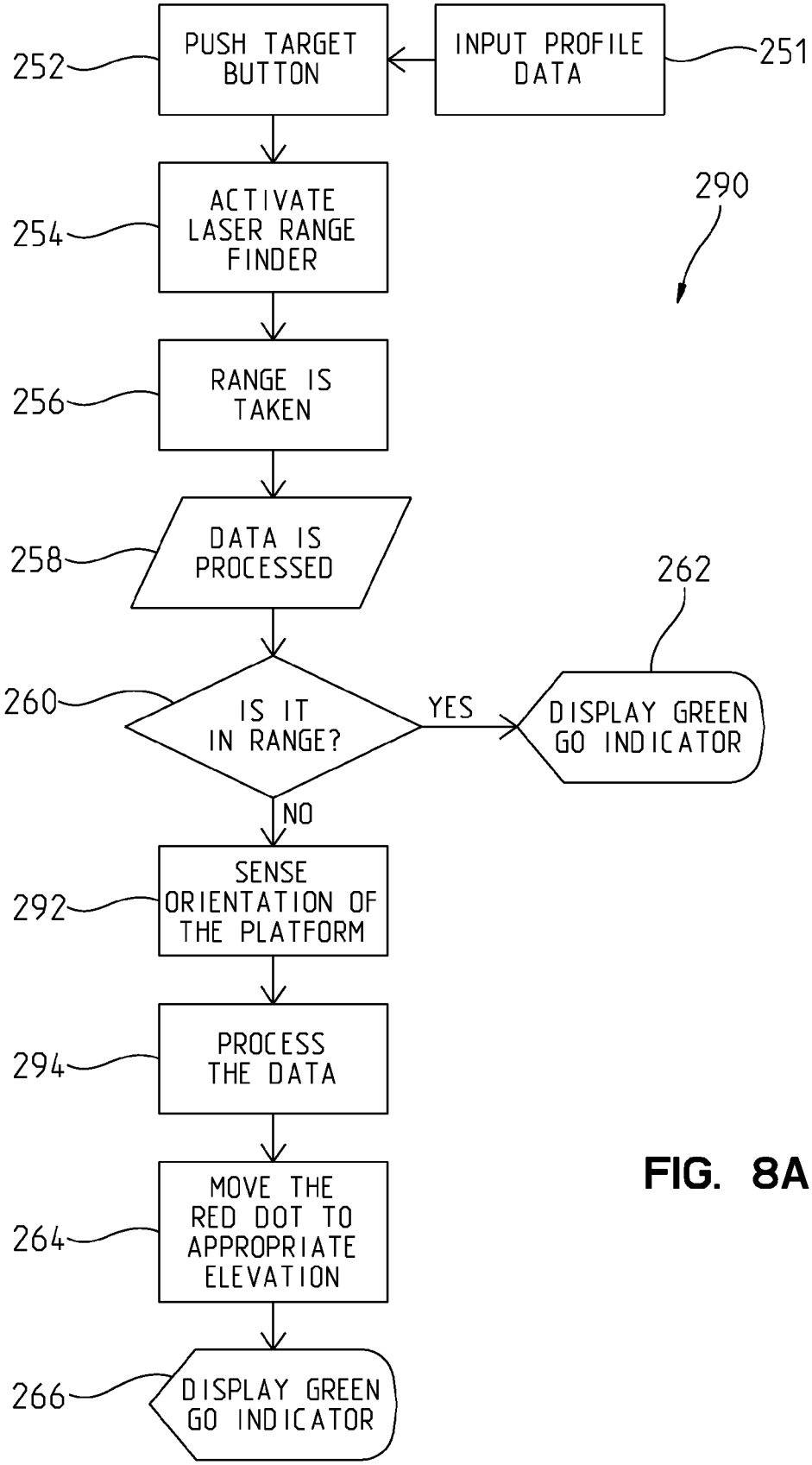
FIG. 8A is a representative view of another processing sequence of the optical sight system of FIG. 1

In one illustrative embodiment, the orientation 286 of firearm 110 and other sensor data 288 may be used to modify a selected exemplary profile 270. This is represented by processing sequence 290 of FIG. 8A. Processing sequence 290 is generally the same as exemplary processing sequence 250 of FIG. 7, except that controller 154 takes into account the orientation of firearm 110 in deciding the correct location of alignment marker 162, as represented by block 292 and 294 in FIG. 8A.

Figure 8B:
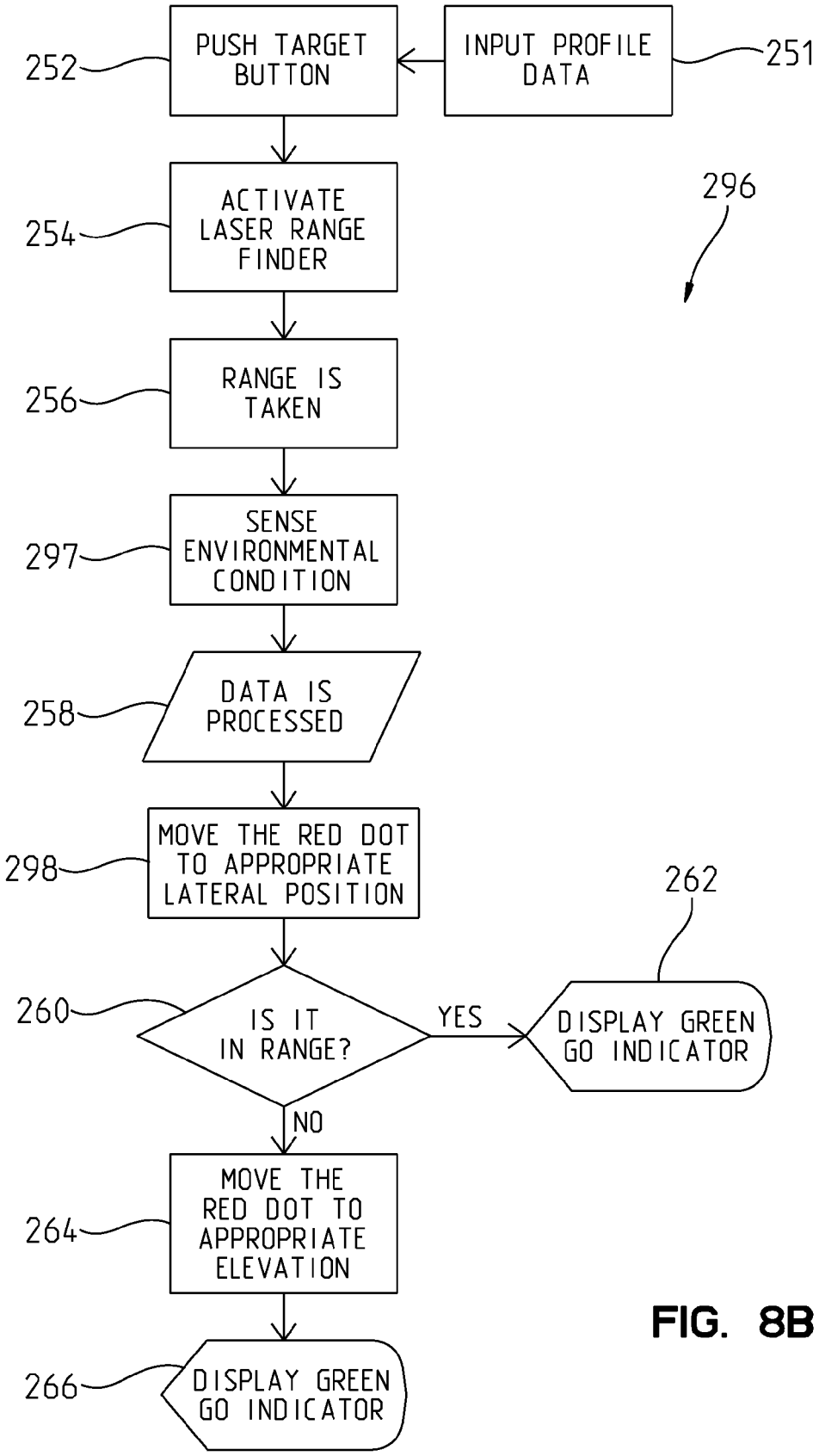
FIG. 8B is a representative view of another processing sequence of the optical sight system of FIG. 1

In another illustrative embodiment, external data such as conditions sensed by environmental sensors 196 (e.g., windage) may be used to modify a selected exemplary profile 270. This is represented by the processing sequence 296 of FIG. 8B. Processing sequence 296 is similar to exemplary processing sequence 250 of FIG. 7, except that controller 154 takes into account sensed environmental conditions in deciding the correct location of alignment marker 162, as represented by block 297. In one illustrative embodiment, range is taken at block 256 and windage is sensed at block 297. The controller 154 processes this data at block 258 and, if necessary, moves the optical source 210 left or right to the appropriate lateral position to accommodate the detected windage. The process then continues to decision block 260 in the manner detailed in connection with processing sequence 250 of FIG. 7.

Referring to FIG. 11, in one embodiment, profile database 182 is stored on memory 174 and memory 174 is local to ranging system 150. Referring to FIG. 12, in one embodiment, profile database 182 is stored on a memory 300 which is accessible by a remote computing system 302 which ranging system 150 may communicate with through a network 304. Remote computing system 302 includes profile selection software 310 which based on one or more of operator identification 280, weapon identification 282, and ballistic identification 284 communicated from ranging system 150 is able to accept the appropriate profile 270.

Both ranging system 150 and remote computing system 302 include respective communication devices 306 and 308 which connect ranging system 150 and remote computing system 302 to the network 304, respectively. Exemplary networks include local area networks, wide area networks, public switched networks, cellular networks, the Internet, an Intranet, and other suitable wireless or wired networks. In one embodiment, ranging system 150 communicates with network 304 over a wireless connection.

Referring to FIG. 3, bow 120 illustratively includes a counter weight 350 supported from a front of bow 120. In one embodiment, counter weight 350 includes rangefinder 190 positioned therein. Bow 120 further includes a portion 352 that includes an optical sight device 354.

Figure 13:
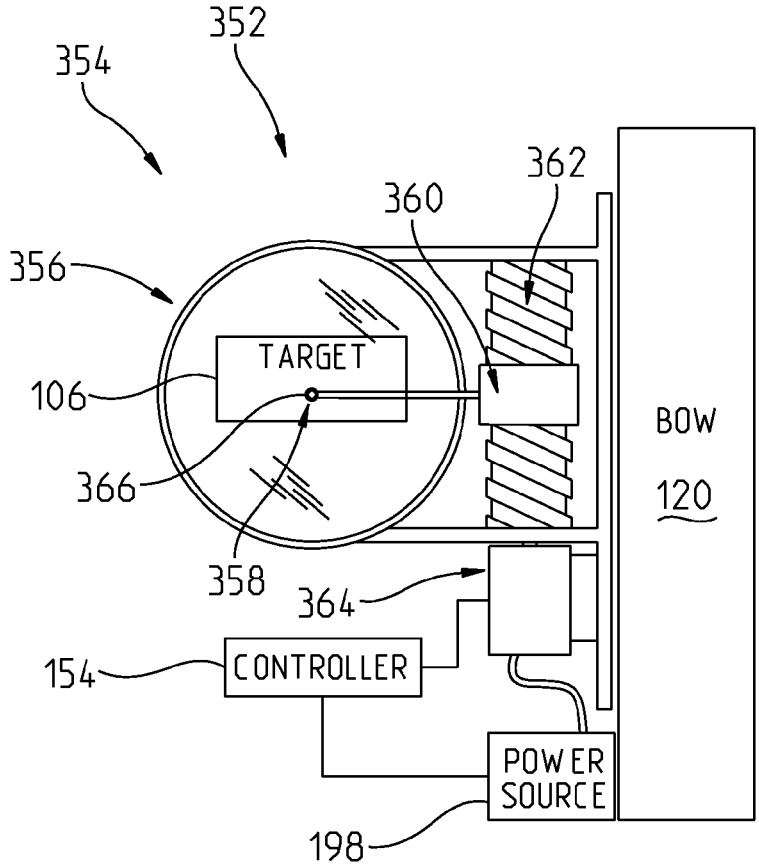
FIG. 13 is a representative view of a moveable mechanical alignment marker of an optical sight system on the bow of FIG. 3.

Referring to FIG. 13, in one illustrative embodiment, portion 352 of bow 120 supports sight device 354 including a sight ring 356 through which an operator 208 looks at target 106. A mechanical sight pin 358 is positioned within sight ring 356. Sight pin 358 is supported by sled 360 which is moveably coupled to a threaded rod 362. Threaded rod 362 is driven by a motor 364. Based on the determined location of an alignment marker 366 of sight pin 358, controller 154 instructs motor 364 to move sled 360. Controller 154 determines the location of alignment marker 366 as disclosed herein.

Figure 14:
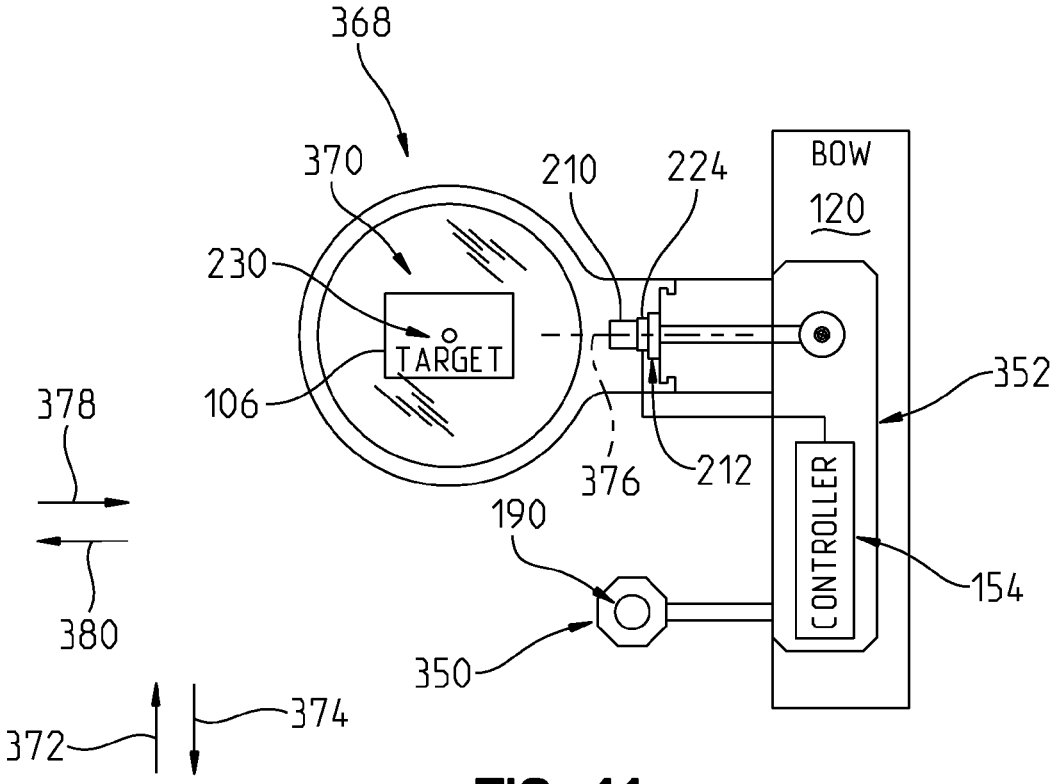
FIG. 14 is a representative end view of an adjustable alignment marker of an optical sight system on the bow of FIG. 3.
Figure 15:
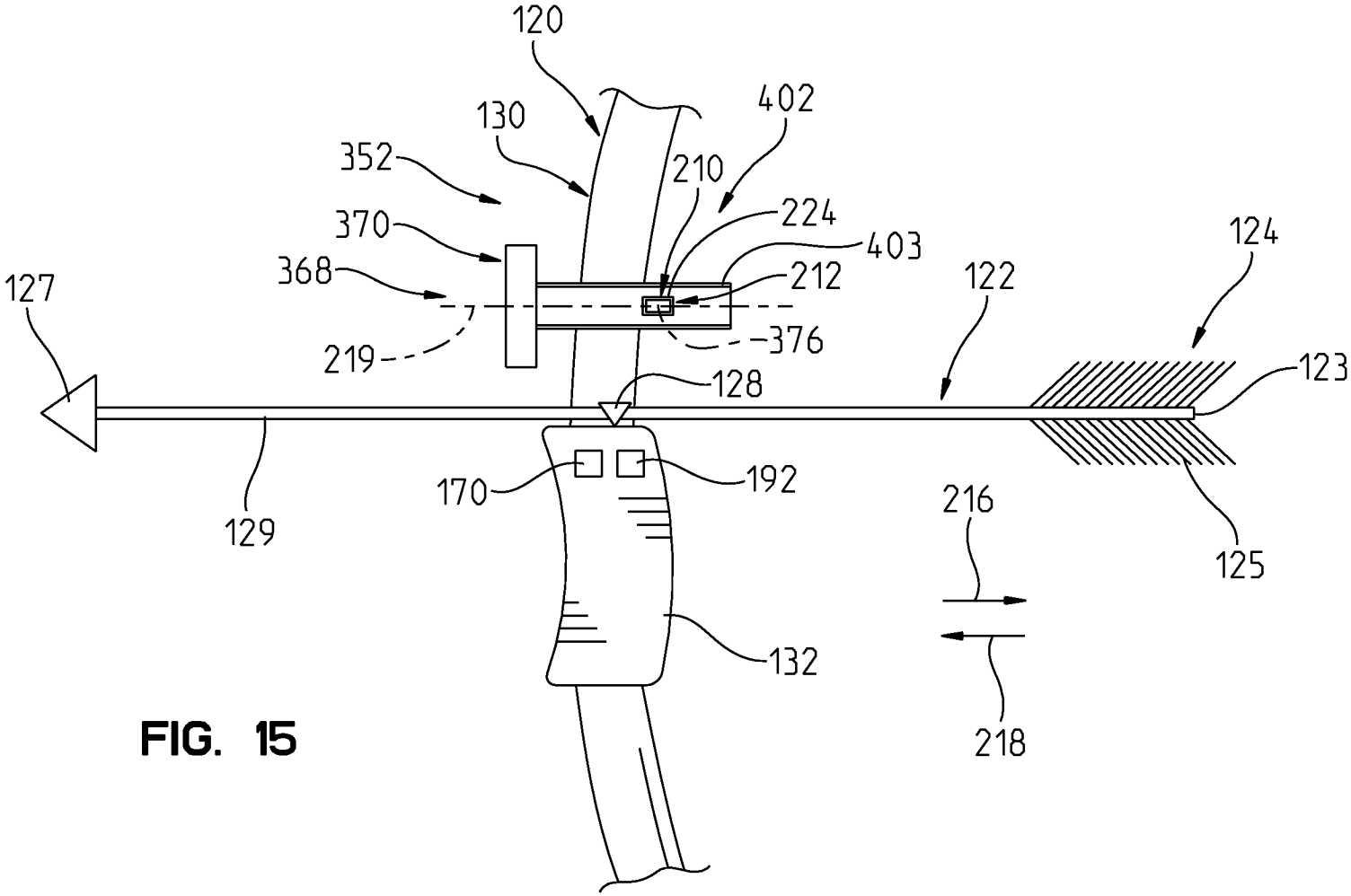
FIG. 15 is a representative side view of the optical sight system of FIG. 14.
Figure 18:
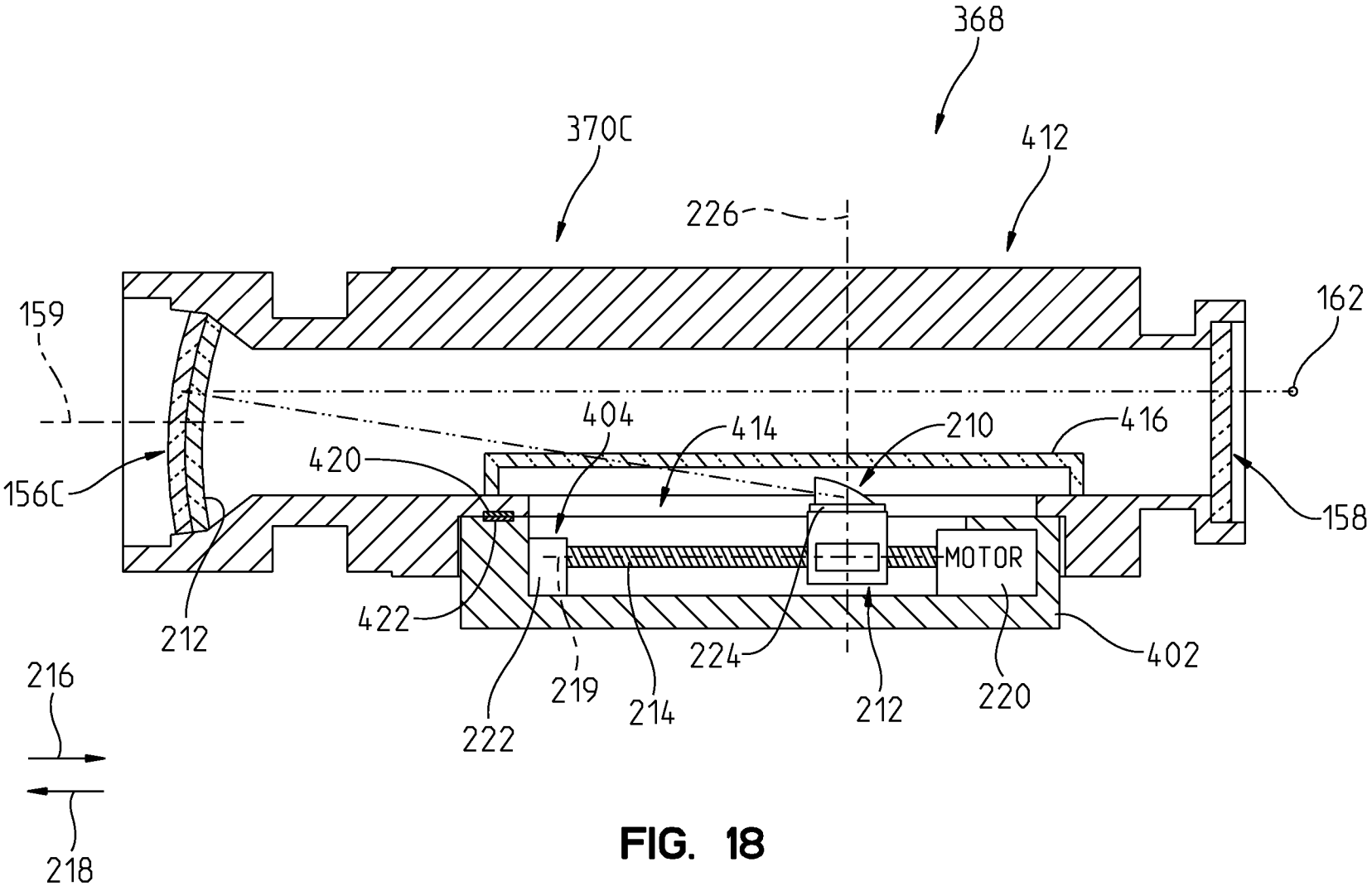
FIG. 18 is a representative longitudinal cross-sectional view of the optical sight system of FIG. 16.

Referring to FIGS. 14 and 15, a further illustrative optical sight device 368 is shown coupled to bow 120. Portion 352 of bow 120 supports optical sight device 368 including light source 210 which projects an alignment marker 230 onto a window 370. In one embodiment, light source 210 is provided on a movable base, illustratively sled 212, so that alignment marker 230 is moved vertically in direction 372 and direction 374 by motor 224 rotating light source 210 about axis 376. As further detailed herein, controller 154 determines an appropriate height of alignment marker 230 at various ranges to target 106. In a further illustrative embodiment, sled 212 is movable along longitudinal axis 219 by rotation of threaded rod 214 by motor 220 (FIG. 18). As such, light source 210 is supported for translational movement along axis 219 in direction 216 and direction 218 (FIG. 15) so that alignment marker 230 is moved horizontally in directions 378 and 380, respectively (FIG. 14). As further detailed herein, controller 154 may determine an appropriate horizontal or lateral position of alignment marker 230 to accommodate sensed environmental conditions, for example, a cross-wind (i.e., windage). In one embodiment, multiple light sources 210 are provided and alignment marker 230 is moved in directions 372, 374, 378, and/or 380 by selecting which one of light sources 210 to activate.

In the embodiment shown in FIGS. 2 and 4, the optical sight device 152 is oriented relative to firearm 110 such that alignment marker 162 is moved vertically (in directions 221 and 223 in FIG. 5) as the sled 212 and light source 210 are moved along axis 219, and alignment marker 162 is moved horizontally (in directions 227 and 229 in FIG. 5) as light source 210 is rotated about axis 226. In the embodiment shown in FIGS. 14 and 15, the optical sight device 368 is supported by bow 120 and rotated 90 degrees about longitudinal axis 159 from the orientation of optical sight device 152 shown in FIGS. 2 and 4 in connection with firearm 110. As further detailed herein, optical sight device 368 is oriented such that alignment marker 230 is moved vertically (in directions 372 and 374 in FIG. 14) as light source 210 is rotated about axis 376, and alignment marker 230 is moved horizontally (in directions 378 and 380 in FIG. 14) as sled 212 and light source 210 are moved along axis 219. The exemplary profile 270 selected from the profile database 182 may be utilized by the controller 154 to determine the proper movement (e.g., rotation or translation) of the light source 210 to provide desired vertical and/or horizontal movement of the alignment marker 162, 230 relative to respective window 156, 370. More particularly, information associated with the weapons ID 282 and/or the lens ID 285 may be used by the controller 154 in determining proper movement of the light source 210 for desired vertical and horizontal positioning of the alignment marker 162, 230.

Figure 16:
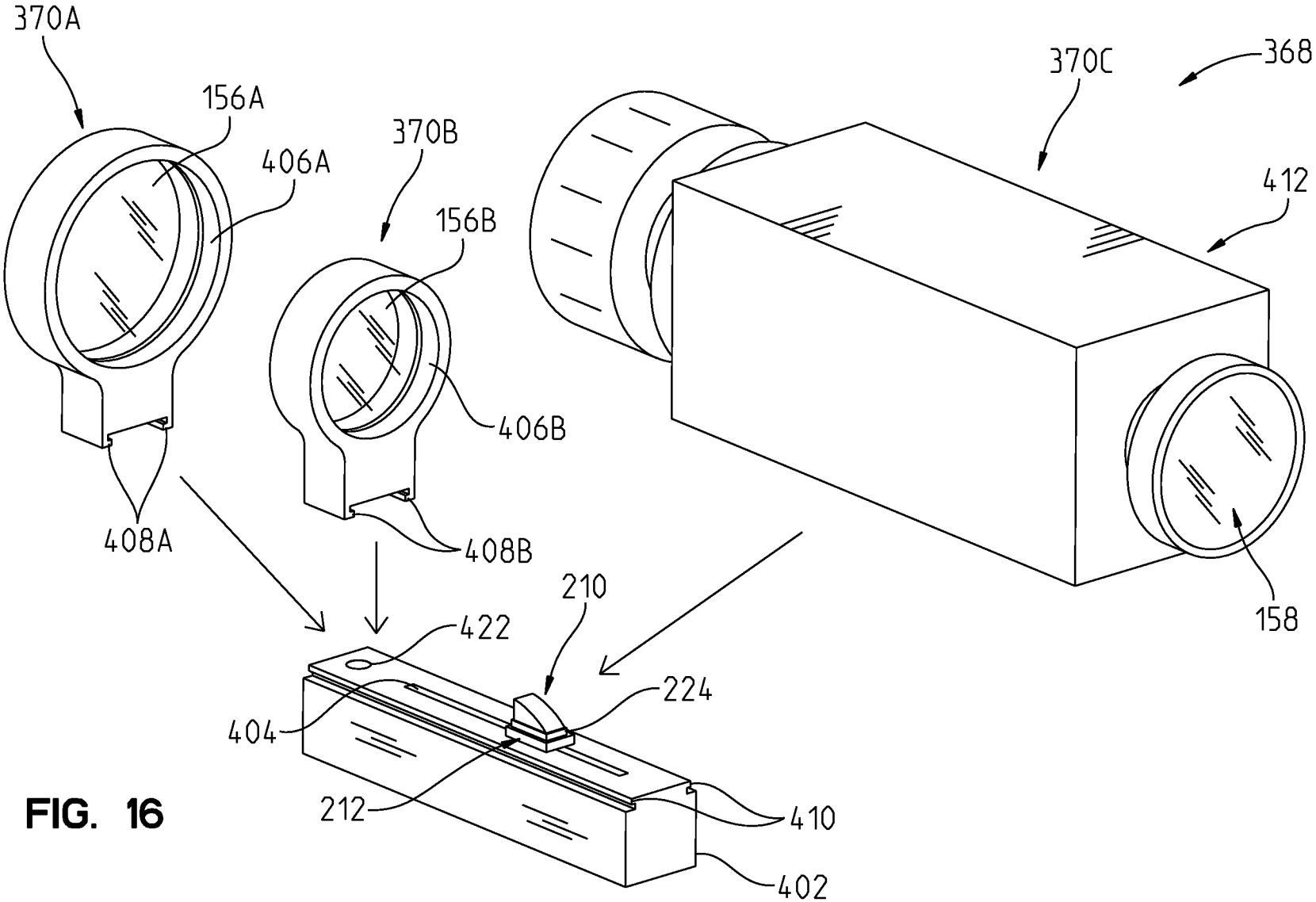
FIG. 16 is a representative top perspective view of an optical sight system including interchangeable windows.
Figure 17:
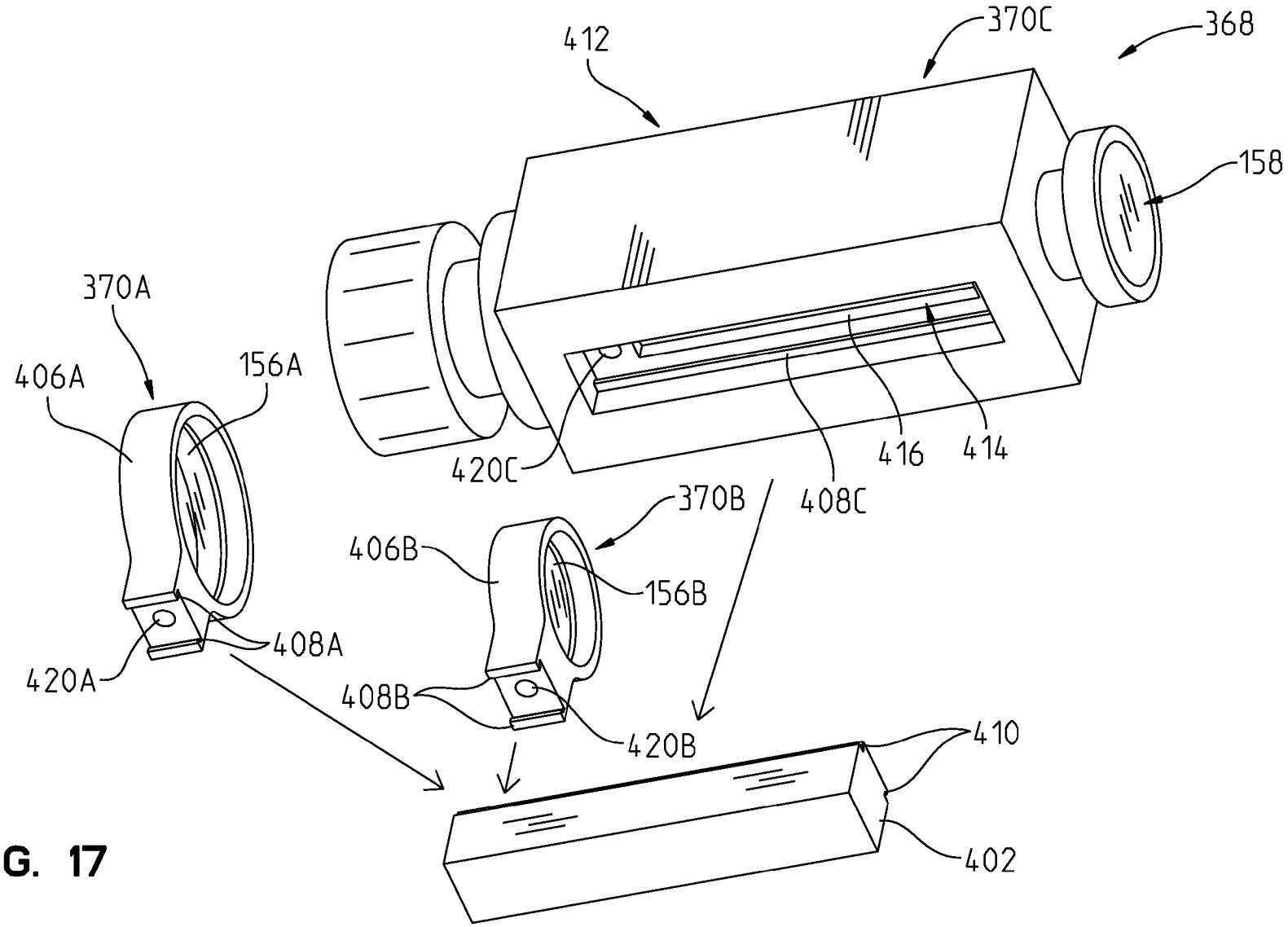
FIG. 17 is a representative bottom perspective view of the optical sight system of FIG. 16.

Referring now to FIGS. 16-18, optical sight device 368 is further illustrated as having a modular construction. More particularly, universal base or mount 402 may be coupled to projectile launching device 100. The mount 402 supports optical source 210 for movement along a longitudinally extending slot 404 in a direction parallel to axis 219. Different windows 370A, 370B, 370C may be interchangeably coupled to the mount 402. Windows 370A and 370B each illustratively includes a frame 406A, 406B supporting a lens or pane 156A, 156B. Releasable couplers, illustratively fingers 408A, 408B, engage within cooperating members, illustratively slots 410, of the mount 402 to releasably couple the respective window 370A, 370B to the mount 402. A compound or multiple component window 370C may likewise be removably coupled to the mount 402 through fingers 408C and slots 410. Fingers 408 and slots 410 may be replaced with other conventional couplers, such as cooperating threads or a bayonet coupling.

As shown in FIG. 18, window 370C illustratively includes a housing 412 supporting a front lens or pane 156C and a rear lens or pane 158. A lower opening 414 is provided in the housing 412 to receive the optical source 210. A protective cover 416 protects the interior of the housing 412 from dust and debris. The housing 412 may be coupled to the mount 402 in a manner similar to that detailed above, for example through fingers 408C engaging slots 410.

An identification device 420 is supported by each window 370A, 370B, 370C and is configured to provide window parameters to the controller 154. More particularly, each identification device 420 is configured to communicate with an interface 422 supported by the mount 402. The interface 422, in turn, is operably coupled to the controller 154 to receive the window parameters from respective identification device 420. As noted herein, such window parameters may include window orientation relative to the projectile launching device 100 (e.g., vertical or horizontal), distance from the light source 210, type of lens (e.g., reflex or red dot, telescopic, fixed reticule, etc.), reflectivity characteristics, etc.

The identification device 420 may include an electrical circuit, such as a resistor or a microchip, configured to provide information on the window 370 to the controller 154. In one illustrative embodiment, an RFID tag may be utilized for identification device 420. When the window 370 is coupled to the mount 402, the identification device 420 is in electrical contact with the interface 422 for providing information to the controller 154. For example, if the identification device 420 is a resistor, the controller 154 will register a change in resistance to identify the window 370, wherein the interchangeable windows 370 are provided with resistors having different resistance values. In the microchip embodiment, the controller 154 would receive information downloaded from the identification device 420. In the RFID embodiment, the controller 154 would sense a unique RFID code. As detailed herein, the controller 154 is configured to utilize the information supplied by the identification device 420 to adjust programming, for example, according to how the window is oriented (horizontal or vertical) or in response to new aiming points.

Figure 19:
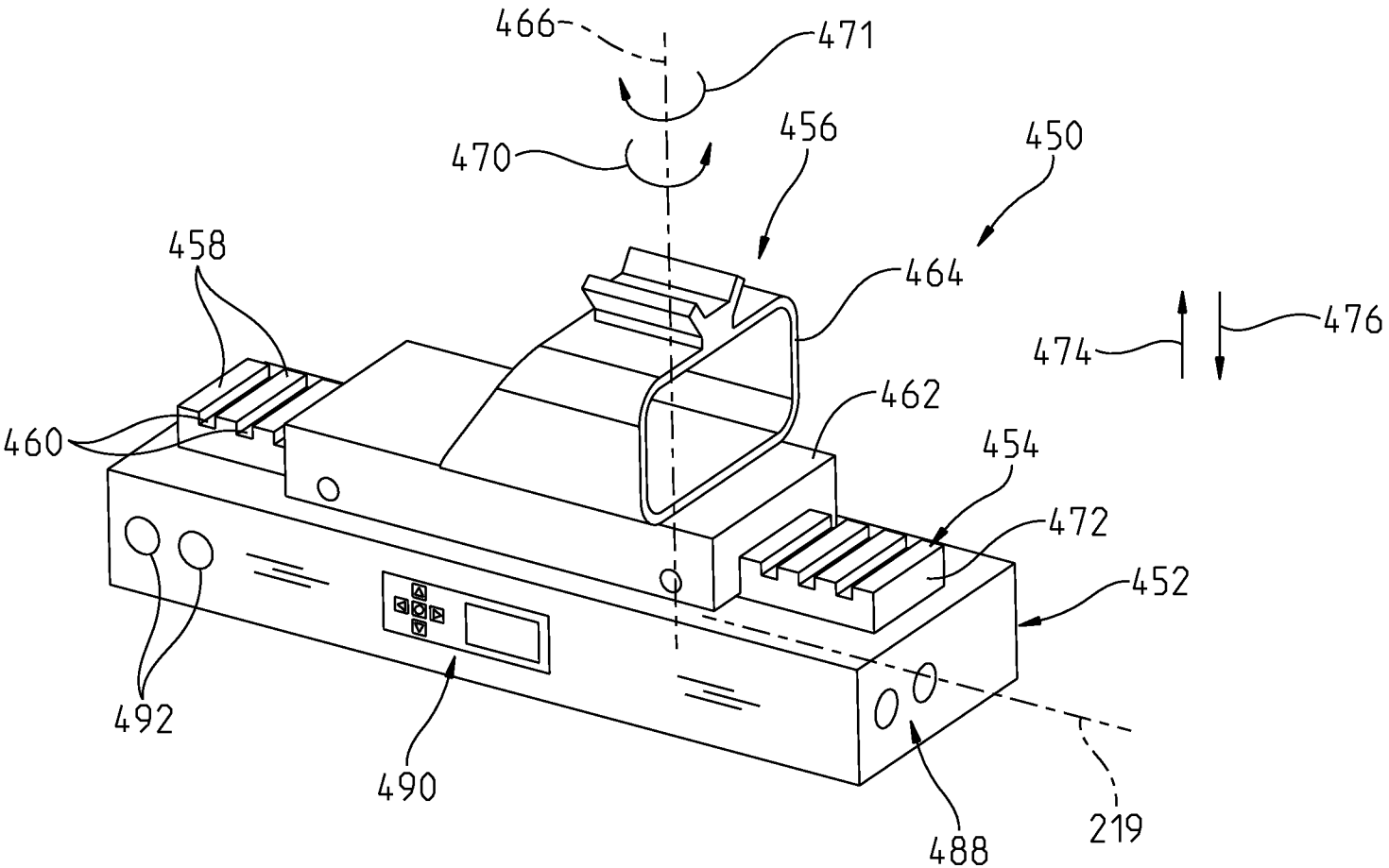
FIG. 19 is a representative perspective view of a rail mounted optical sight system.
Figure 20:
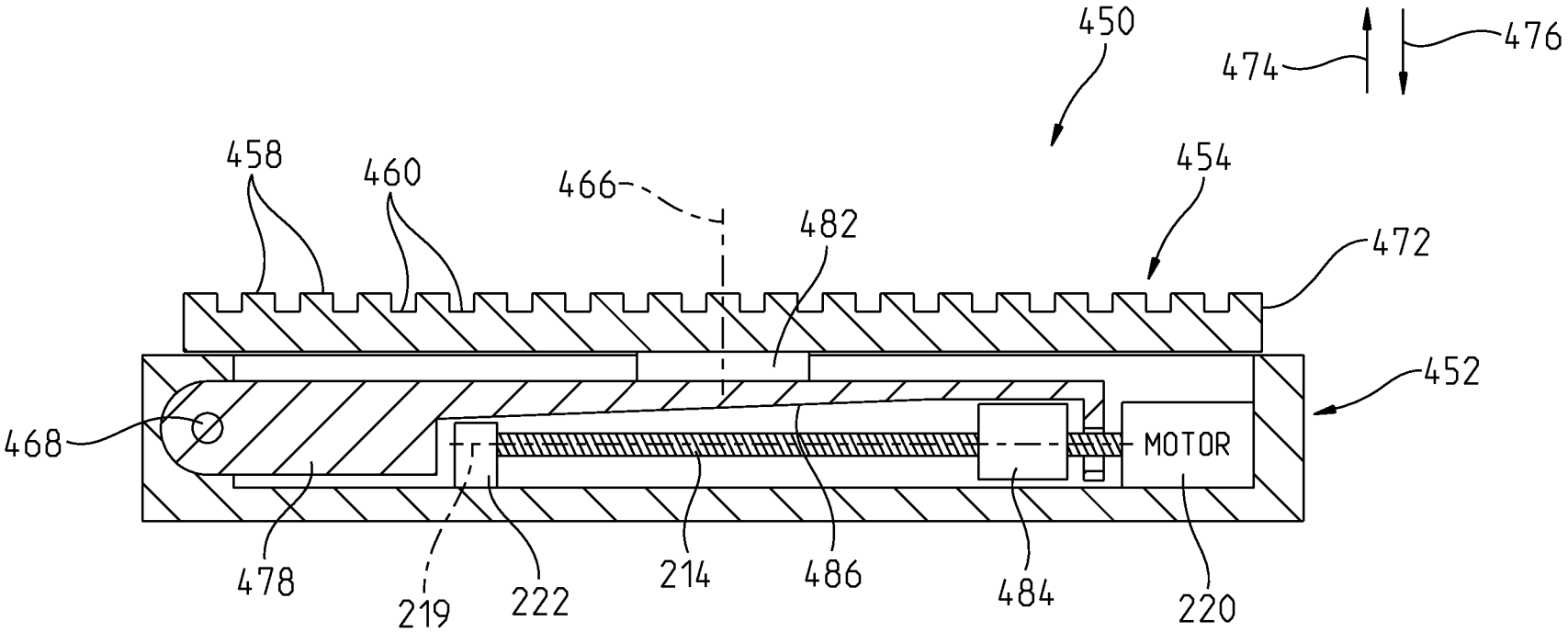
FIG. 20 is a representative longitudinal cross-sectional view of the optical sight system of FIG. 19.

With reference to FIGS. 19 and 20, a further illustrative optical sight device 450 is shown for use with projectile launching device 100. The optical sight device 450 illustratively includes a mount 452 supporting a mounting platform, illustratively a Picatinny mounting rail 454, configured to couple to a conventional optical sight 456. As is known, the mounting rail 454 may be of standard design including a plurality of ridges 458 and interspaced grooves or slots 460. The mount 452 may be secured to the projectile launching device 100 using standard mounting connections.

The optical sight 456 illustratively includes a base 462 configured to releasably couple to the mounting rail 454 and supporting a window 464. The optical sight 456 illustratively includes at least two degrees of freedom. More particularly, the mounting rail 454 is supported for pivoting movement about orthogonal rotational axes 466 and 468. Pivoting movement about axis 466 is represented by arrows 470 and 471 in FIG. 19, while pivoting movement about axis 468 causes a rear end 472 of the mounting rail 454 to move in the direction of arrows 474 and 476 in FIGS. 19 and 20. Pivoting movement about axis 466 may be used by the controller 154 to adjust for windage, while pivoting movement about axis 468 may be used by the controller 154 to adjust for range.

The mounting rail 454 is supported by an arm 478 pivotable about rotational axis 468. A motor 482 is operably coupled to controller 154 and is configured to couple the mounting rail 454 to the arm 478 for pivoting movement about rotational axis 466. Motor 220 is configured to rotate threaded rod 214 and drive actuator block or sled 484 in translational movement along longitudinal axis 219. As sled 484 moves, it engages an inclined surface 486 to cause arm 478 to pivot about rotational axis 468. Weight of the motor 482, the mounting rail 454, and the optical sight 456 will tend to bias the arm 478 downwardly thereby maintaining engagement between the sled 484 and the inclined surface 486. Other biasing means, such as a spring, may also be used to maintain engagement between the sled 484 and the arm 478.

With further reference to FIG. 19, a laser rangefinder 488 is illustratively supported within mount 452. A user interface 490 may be supported by the mount 452 for entering and altering data provided to the controller 154, including reference profile information 178. Conventional connections 492 may be provided in the mount 452 for coupling to remote switches, software upgrades, and/or data exchanges with remote computers. Illustratively, the controller 154 and power source 198 are received within the mount 452.

While this invention has been described as having an exemplary design, the present invention may be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains.

The invention claimed is:

1. A method of indicating the expected location of a projectile relative to a target object with an optical sight, the method comprising the steps of:

supporting an optical sight on a projectile launcher, the optical sight including a window;

coupling an identification device of the window to a controller;

identifying electronically an optical sight type parameter of the window device based on sensing and matching an electronic identifier from said window and matching said identifier with a profile stored in a library of profiles, wherein the library of profiles includes parameters of the optical sight, projectile launching device identification information, ranging system information, and ballistic identification information, said library of profiles further includes a plurality of projectile launcher operator identification information comprising a plurality of operator identifiers and operator calibration information associated with each of the operator identifiers, said operator calibration information is determined based on storage into said library of profiles of previous sight adjustments by a projectile launcher operator associated with the projectile launcher operator identification information;

providing a user interface adapted to permit selection of one of the plurality of projectile launcher operator information;

selecting one of the operator identifier information in said library of profiles using the user interface;

determining a range to the target object;

providing an alignment marker within the window of the optical sight;

calibrating a position of the alignment marker based on said profile including the parameter of the window and said projectile operator information which is used to perform operator unique position calibration of the alignment marker;

altering the position of the alignment marker within the window of the optical sight based at least on the range to the target object, a selected said profile stored in said library of profiles, said selected one of the operator identifier information, wherein the step of altering a position of the alignment marker includes the steps of: providing on a moveable base a first optical source which produces the alignment marker; and moving the movable base so that the alignment marker is in the altered position;

providing a target acquired indicator viewable with the window of the optical sight, wherein the alignment marker is further adapted to alter to display a first and second state, wherein said alignment marker changing from said first state to said second state when the target has been acquired, said target acquired state further indicates the movable base has completed movement so that the alignment marker is in the altered position;

wherein the optical sight includes a mount supporting the window, and the parameter of the window includes at least one of the maximum distance of the window from the optical source and the orientation of the window relative to the projectile launching device.

2. The method of claim 1, wherein the step of providing an alignment marker comprises providing only a single alignment marker within the window of the optical sight.

3. The method of claim 1, wherein the range to the target object is determined with a laser rangefinder.

4. The method of claim 1, wherein the alignment marker is a dot.

5. The method of claim 1, wherein the first state is a first color and the second state is a second color.

6. The method of claim 1, wherein the mount includes a longitudinal axis, the mount being oriented in a first position when mounted on a firearm, and the mount being oriented in a second position when mounted on a bow, the second position being rotated 90 degrees about the longitudinal axis from the first position.

7. The method of claim 1, wherein the movable base includes at least two degrees of freedom.

8. The method of claim 7, wherein the first degree of freedom is translational movement along a longitudinal axis of the mount, and the second degree of freedom is pivoting movement about a rotational axis extending perpendicular relative to the longitudinal axis.

9. The method of claim 1, wherein the moveable base includes a sled, and a threaded rod threadably engaged with the sled to advance the sled in a first direction and to retract the sled in a second direction, and a motor coupled to the threaded rod to rotate the threaded rod.

10. The method of claim 9, wherein the first optical source is pivotably coupled to the sled.

11. The method of claim 1, further comprising the steps of:

retrieving the profile from a database;

determining based on the profile and the determined range to the target the position of the alignment marker.

12. A method as in claim 1, wherein the user interface is a graphical user interface adapted to permit selection of one of the plurality of projectile launcher operator information;

wherein said selecting of one of the operator identifier information in said library of profiles is performed using the user interface.

13. A ranging system for use with a projectile launching device to aim at a target object, the ranging system comprising:

a rangefinder supported by the projectile launching device and configured to determine a range to the target object;

an optical sight supported by the projectile launching device and including an identification device for electronically providing a parameter of the optical sight based on sensing and matching an electronic optical sight identifier from said optical sight and matching said identifier with a profile stored in a library of profiles, wherein the previously stored profiles includes the parameter of the optical sight, projectile launching device identification information, ranging system information, and ballistic identification information, said library of profiles further includes projectile launcher operator identification information comprising calibration information determined based on previous sight adjustments by an operator associated with the projectile launcher operator identification information, the optical sight further including a field of view, the target object being viewable through the field of view;

at least one optical source which provides an alignment marker within the field of view of the optical sight, the alignment marker indicating a position that a projectile of the projectile launching device will hit at the location of the target object, wherein the alignment marker is further adapted to display a first and second state, said second state is displayed when the target has been acquired and a movable base has completed movement so that the alignment marker is in an altered position;

a user interface adapted to permit selection of one of the plurality of projectile launcher operator information adapted to permit said operator to select one of the operator identifier information in said library of profiles using the user interface;

a controller operably coupled to the rangefinder and the at least one optical source and an interface supported by the projectile launching device and configured to couple the identification device of the optical sight with the controller, wherein the controller determines a position of the alignment marker within the field of view of the optical sight based at least on the range to the target object, a selected said profile stored in said library of profiles, said selected one of the operator identifier information, and the parameter from the identification device.

14. The ranging system of claim 13, further comprising a sled which supports the at least one optical source, the sled being movable and a position of the alignment marker being determined based on a position of the sled.

15. The ranging system of claim 14, further comprising a threaded rod threadably engaged with the sled to advance the sled in a first direction and to retract the sled in a second direction and a motor coupled to the threaded rod to rotate the threaded rod.

16. The ranging system of claim 14, wherein the movable base includes at least two degrees of freedom.

17. The ranging system of claim 16, wherein the first degree of freedom is translational movement along the longitudinal axis of the mount, and the second degree of freedom is pivoting movement about a rotational axis extending perpendicular relative to the longitudinal axis.

18. The ranging system of claim 14, wherein the optical source includes a window removably supported on the sled, the profile input device including an identification member coupled to the window and in communication with the controller for determining the parameter of the optical sight.

19. The ranging system of claim 13, further comprising a target input device, wherein the controller based on an input of the target input device activates the rangefinder.

20. The ranging system of claim 13, wherein the profile is retrieved from a remote computing device.

21. The ranging system of claim 13, wherein the base includes a longitudinal axis, the mount being oriented in a first position when mounted on a firearm, and the mount being oriented in a second position when mounted on a bow, the second position being rotated 90 degrees about the longitudinal axis from the first position.

22. The ranging system of claim 13, wherein the controller further determines the position of the alignment marker based on a reading from at least one environment sensor.

23. The ranging system of claim 22, wherein a first environment sensor is one of a wind sensor, a temperature sensor, and a humidity sensor.

24. The ranging system of claim 13, wherein a window defines the field of view, and the parameter of the optical sight includes at least one of the maximum distance of the window from the optical source and the orientation of the window relative to the projectile launching device.

25. A ranging system for use with a projectile launching device to aim at a target object, the ranging system comprising:

a rangefinder supported by the projectile launching device and configured to determine a range to the target object;

an optical sight supported by the projectile launching device;

the optical sight including a mount, a window supported by the mount, and a coupler removably coupling the window to the mount, the window including an identification device for electronically providing a parameter of the window based on sensing and matching an electronic optical sight identifier from said window and matching said identifier with a profile stored in a library of profiles, wherein the profile stored in a library of profiles includes parameters of the optical sight projectile launching device identification information, ranging system information, and ballistic identification information, said library of profiles further includes projectile launcher operator identification information comprising calibration information determined based on previous sight adjustments by an operator associated with the projectile launcher operator identification information the optical sight permitting the viewing of the target object through the window;

an optical source providing an alignment marker within the window of the optical sight, the alignment marker indicating a position that a projectile of the projectile launching device will hit at the location of the target object;

an interface supported by the mount and operably coupled to the identification device of the window; and a controller operably coupled to the rangefinder, the interface, and the optical source, the controller determining a position of the alignment marker within the window of the optical sight based at least on the range to the target object, a selected said profile stored in said library of profiles, said one of the operator identifier information, and the parameter of the optical window.

26. The ranging system of claim 25, further comprising a user input device operably coupled to the controller to calibrate the position of the alignment marker within the window of the optical sight.

27. The ranging system of claim 25, further comprising an actuator operably coupled to the controller and configured to adjust the relative position of the optical source and the optical window.

28. The ranging system of claim 27, further comprising a sled operably coupled to the actuator and which supports the optical source, the sled being movable by actuation of the actuator, and a position of the alignment marker being determined based on a position of the sled.

29. The ranging system of claim 28, wherein the actuator includes a threaded rod threadably engaged with the sled to advance the sled in a first direction and to retract the sled in a second direction, and a motor coupled to the threaded rod to rotate the threaded rod.

30. The ranging system of claim 27, wherein the movable base includes at least two degrees of freedom.

31. The ranging system of claim 30, wherein the first degree of freedom is translational movement along a longitudinal axis of the mount, and the second degree of freedom is pivoting movement about a rotational axis extending perpendicular relative to the longitudinal axis.

32. The ranging system of claim 25, further comprising a target input device, wherein the controller based on an input of the target input device activates the rangefinder.

33. The ranging system of claim 25, wherein a plurality of said profiles are used by the controller to calibrate the position of the alignment marker within the field of view of the optical sight, the profile being based on the parameter of the optical sight and at least one of operator identification information, projectile launching device identification information, and ballistic identification information.

34. The ranging system of claim 33, wherein the profile is retrieved from a remote computing device.

35. The ranging system of claim 25, wherein the mount includes a longitudinal axis, the mount being oriented in a first position when mounted on a firearm, and the mount being oriented in a second position when mounted on a bow, the second position being rotated 90 degrees about the longitudinal axis from the first position.

36. The ranging system of claim 25, wherein the window includes a lens, and a frame supporting the lens, the coupler including a pair of fingers engageable with the base.

37. The ranging system of claim 25, wherein the parameter of the window includes at least one of the maximum distance of the window from the optical source and the orientation of the window relative to the projectile launching device.

* * * * *